US008838014B2

(12) United States Patent
Matsue et al.

(10) Patent No.: US 8,838,014 B2
(45) Date of Patent: Sep. 16, 2014

(54) BOOKBINDING SYSTEM USING UNFIXED TONER IMAGE AS ADHESIVE

(75) Inventors: Natsumi Matsue, Kanagawa (JP); Koichi Kudo, Kanagawa (JP); Tetsuo Watanabe, Kanagawa (JP); Takashi Hashimoto, Kanagawa (JP); Fumihito Masubuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 61 days.

(21) Appl. No.: 13/311,925

(22) Filed: Dec. 6, 2011

(65) Prior Publication Data

US 2012/0155944 A1 Jun. 21, 2012

(30) Foreign Application Priority Data

Dec. 17, 2010 (JP) ..... 2010-282429

(51) Int. Cl.
*G03G 15/00* (2006.01)

(52) U.S. Cl.
CPC .. *G03G 15/6541* (2013.01); *G06G 2215/00835* (2013.01); *G03G 15/6544* (2013.01); *G03G 2215/00936* (2013.01)
USPC ..... 399/409; 399/408

(58) Field of Classification Search
CPC ..... G03G 15/6544
USPC ..... 399/409, 408
See application file for complete search history.

(56) References Cited

U.S. PATENT DOCUMENTS 5,014,092 A * 5/1991 Kubo et al. ..... 399/409
5,531,429 A * 7/1996 Clark ..... 270/58.11
5,628,406 A * 5/1997 Yoshida et al. ..... 209/38
5,950,062 A * 9/1999 Yahata et al. ..... 399/358
6,394,728 B1 * 5/2002 Boss ..... 412/1
6,459,880 B1 10/2002 Russell
7,260,354 B2 * 8/2007 Ishida ..... 399/409
7,296,791 B2 * 11/2007 Kurahashi et al. ..... 271/176
7,403,737 B2 * 7/2008 Coleman et al. ..... 399/322

(Continued)

FOREIGN PATENT DOCUMENTS

EP 1 208 999 A2 5/2002
EP 1 208 999 A3 5/2002

(Continued)

OTHER PUBLICATIONS

Combined Chinese Office Action and Search Report issued Feb. 28, 2014 in Patent Application No. 201110414074.6 (with English translation).

*Primary Examiner* — Daniel J Colilla
*Assistant Examiner* — John M Royston
(74) *Attorney, Agent, or Firm* — Oblon, Spivak, McClelland, Maier & Neustadt, L.L.P.

(57) ABSTRACT

A bookbinding system includes an image forming unit to form a toner image on a sheet; a fixing device to fix the toner image onto the sheet; a sheet stacker to load sheets passing through the fixing device, to create a sheet bundle, in which the sheet bundle stacked on the sheet stacker is adhered to produce a complete book; an adhesive toner image forming unit to form an adhesive toner image on an area corresponding to a spine of the complete book; and a heater to heat the unfixed adhesive toner image formed on each sheet of the sheet bundle stacked on the sheet stacker, wherein the adhesive toner image on the sheet stacked on the sheet stacker is the unfixed toner image.

22 Claims, 18 Drawing Sheets

(56) References Cited

U.S. PATENT DOCUMENTS

| | | | | |
|---|---|---|---|---|
| 2002/0067935 | A1* | 6/2002 | McIntyre | 399/320 |
| 2004/0247357 | A1* | 12/2004 | Frauens et al. | 399/409 |
| 2005/0265765 | A1* | 12/2005 | Honmochi et al. | 399/408 |
| 2008/0157466 | A1* | 7/2008 | Fukatsu et al. | 271/303 |
| 2008/0304847 | A1* | 12/2008 | Hirano | 399/67 |
| 2009/0035002 | A1 | 2/2009 | Kushida et al. | |

FOREIGN PATENT DOCUMENTS

| | | | |
|---|---|---|---|
| JP | 2003-94854 | A | 4/2003 |
| JP | 2004-209859 | | 7/2004 |
| JP | 2005-162352 | | 6/2005 |
| JP | 2005219849 | A * | 8/2005 |
| JP | 2008-55677 | | 3/2008 |
| JP | 2009-223062 | | 10/2009 |

* cited by examiner

BOOKBINDING SYSTEM USING UNFIXED TONER IMAGE AS ADHESIVE

CROSS-REFERENCE TO RELATED APPLICATIONS

The present application claims priority from Japanese patent application number 2010-282429, filed on Dec. 17, 2010, the entire contents of which are incorporated by reference herein.

FIELD OF THE INVENTION

The present invention relates to an integrated bookbinding system to perform steps from image formation to bookbinding.

BACKGROUND OF THE INVENTION

A bookbinding system is known in which a plurality of sheets on which images are formed by an image forming apparatus is bundled into a sheet bundle, and an adhesive is applied to a spine of the sheet bundle to produce a complete book.

Thus, JP-2008-55677-A discloses a bookbinding system that forms an adhesive toner image on a binding edge portion of each sheet using the image forming apparatus. Specifically, in an image forming unit of the image forming apparatus, a regular toner image is transferred to the sheet based on image data as well as the adhesive toner image is transferred to a portion corresponding to the spine edge of the sheet. The sheets on which these toner images are formed are conveyed to a fixing device, and are sequentially sent to a bookbinding processor after the toner images are fixed onto each sheet. The plurality of sheets conveyed to the bookbinding processor forms a sheet bundle stacked on a stack section. Next, a spine edge portion of the sheet bundle is coated with an adhesive heated by a heater. The adhesive toner image is heated and softened by the heated adhesive to thus serve as an adhesive to attach adjacent sheets to each other. As a result, the adjacent sheets are attached to each other by the adhesive toner image and the adhesive.

However, in the bookbinding system as disclosed in JP-2008-55677-A, because the adhesive toner image once heated and softened by the fixing device and fixed onto the sheet and the adhesive coated on the spine portion of the sheet bundle are used to attach the adjacent sheet to each other, some means for applying the adhesive on the spine portion of the sheet bundle is required, which increases the cost of the apparatus. However, if binding of the sheet bundle is performed using the adhesive toner image alone after fixation, the adhesive force is weak and sheets are separated easily from the booklet.

BRIEF SUMMARY OF THE INVENTION

The present invention provides an improved bookbinding system capable of attach the sheets to each other by use of adhesive toner image only.

The inventors of the present invention have found that by attaching the adjacent sheets with an unfixed toner image, the sheets are more firmly attached to each other than when using the toner image after fixation. The present invention provides, therefore, an optimal bookbinding system having an adhesive toner image forming unit to form an adhesive toner image on a sheet; a fixing device to fix the toner image onto the sheet; and a sheet stacker to load the sheet which has passed through the fixing device. The sheet bundle stacked on the sheet stacker is adhered to produce a complete book. The optimal bookbinding system further includes an adhesive toner image forming unit and a heater. The adhesive toner image forming unit forms an adhesive toner image on an area corresponding to a spine of the complete book. The heater heats the unfixed adhesive toner image formed on each sheet of the sheet bundle stacked on the sheet stacker, in which the adhesive toner image on the sheet stacked on the sheet stacker is the unfixed toner image.

These and other objects, features, and advantages of the present invention will become apparent upon consideration of the following description of the preferred embodiments of the present invention when taken in conjunction with the accompanying drawings.

DETAILED DESCRIPTION OF THE INVENTION

Hereinafter, preferred embodiments of the present invention will be described with reference to accompanying drawings.

Figure 1:
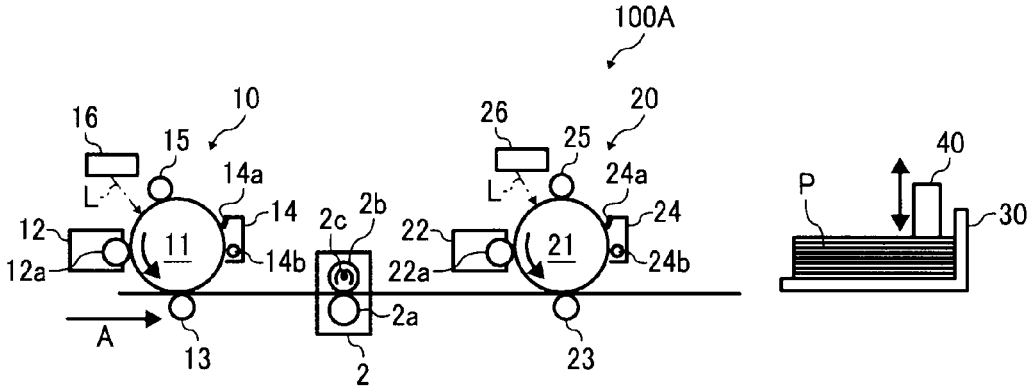
FIG. 1 is a general configuration of a bookbinding system according to a first embodiment of the present invention.

FIG. 1 is a general configuration of a bookbinding system 100A according to a first embodiment of the present invention. As illustrated in FIG. 1, the bookbinding system includes, in a sheet conveyance direction (that is, in the direction of arrow A in the figure), an image forming unit 10, a fixing device 2, an adhesive toner image forming unit 20, a sheet stacker 30, and a heater 40.

The above image forming unit 10, the fixing device 2, the adhesive toner image forming unit 20, the sheet stacker 30, and the heater 40 may be included in an image forming apparatus. In this case, for example, the adhesive toner image forming unit 20 and the sheet stacker 30 may be provided in another post-processing device separate from the image forming apparatus where the latter is a multifunction printer or a product printing device.

The image forming unit 10 includes a photoreceptor 11 as an image carrier rotating in the direction indicated by an arrow in the figure, a charger 15, an exposure unit 16, a developing device 12, a transfer device 13, and a cleaning device 14, which are sequentially disposed around the photoreceptor 11. The charger 15 being a charging means is disposed in contact or non-contact with the photoreceptor 11 and serves to apply bias voltage to the photoreceptor 11 so that the photoreceptor 11 is charged in a predetermined polarity and at a predetermined electrical potential. The exposure unit 16 as a latent image forming means uses a LD or an LED as a light emitting device and radiates light L modulated by the image data to the photoreceptor 11 charged by the charger 15, thereby forming an electrostatic latent image on the photoreceptor 11. The developing device 12 as a developing means includes a developer carrier 12*a* and a built-in magnet roller fixed inside the developer carrier 12*a*, and holds the developer on the developer carrier 12*a*. In the present embodiment, two-component developer formed of toner and carrier and two-component electromagnetic brush developing method suitable for the type of developer are used. However, one-component developing method without using carrier can also be used. A developing bias supply source applies voltage to the developer carrier 12*a*. Due to the difference in the electric potential between the developing bias and the electrostatic latent image formed on the photoreceptor 11, the charged toner on the electrostatic latent image in the developing area is adhered, thereby performing development. The transfer device 13 as a transfer means contacts, in a transfer operation, a surface of the photoreceptor 11 at a predetermined pressing force and applies voltage thereto, thereby transferring a toner image on the surface of the photoreceptor 11 at a transfer nip between the photoreceptor 11 and the transfer device 13. In the present embodiment, a transfer roller is used as a transfer device 13; however, a scorotron or a transfer belt may be used as a transfer device. The cleaning device 14 as a cleaning means serves to remove residual toner on the photoreceptor 11 after transferring operation by the transfer device 13.

The cleaning device 14 includes a cleaning blade 14*a* to remove residual toner on the photoreceptor 11 and a toner conveyer 14*b* to convey the cleaned toner or waste toner to a waste toner bottle. The cleaning blade 14*a* is contacted, with pressure, the rotating photoreceptor 11 so that the residual toner is removed from the photoreceptor 11. The toner removed from the photoreceptor 11 by the cleaning blade 14*a* is collected in the waste toner bottle, not shown, as waste toner.

The fixing device 2 serving to fix a toner image on the sheet is disposed downstream in the sheet P conveyance direction than the transfer device 13. The fixing device 2 includes a heat roller 2*b* as a heating member to include a heat source such as a halogen lamp, not shown, and a pressure roller 2*a* as a nip forming member to press the heat roller 2*b* to form a fixing nip.

Figure 2A:
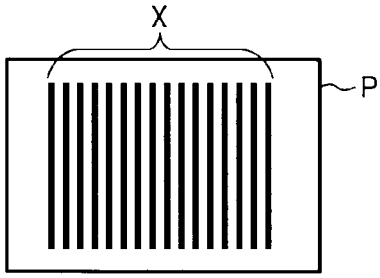
FIG. 2A is a view illustrating a sheet after having passed an image forming unit.

The sheet P which has been conveyed from a sheet container, not shown, reaches the image forming unit 10, where a toner image X as illustrated in FIG. 2A is formed thereon, and is sandwiched in the fixing nip inside the fixing device 2. Then, the toner image X is fixed onto the sheet P by heat and pressure in the fixing nip, and the sheet P is conveyed to the adhesive toner image forming unit 20.

Figure 2B:
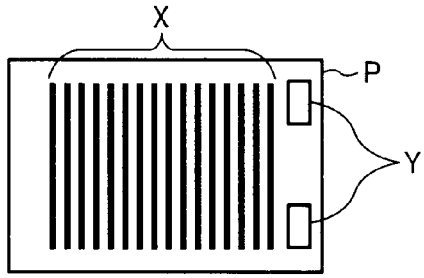
FIG. 2B is a view illustrating a sheet after having passed an adhesive toner image forming unit.

The adhesive toner image forming unit 20 includes a configuration similar to that of the image forming unit 10. Specifically, the adhesive toner image forming unit 20 includes a photoreceptor 21 as an image carrier rotating in the direction indicated by an arrow in the figure, and a charger 25, an exposure unit 26, a developing device 22, a transfer device 23, and a cleaning device 24 which are sequentially disposed around the photoreceptor 21. The exposure unit 26 radiates light L modulated by the adhesive toner image data corresponding to the adhesive toner image to the photoreceptor 21 charged by the charger 25, thereby forming an adhesive electrostatic latent image on the photoreceptor 21. This adhesive electrostatic latent image is developed by the developing device 22, and the adhesive toner image Y formed on the photoreceptor is transferred to a predetermined position on the sheet as illustrated in FIG. 2B. The toner to be used as an adhesive contained in the developing device 22 of the adhesive toner image forming unit 20 preferably has a lower melting point compared to the toner for image formation contained in the developing device 12 of the image forming unit 10. Thus, because the low-melting-point toner is used as the toner for adhesive toner image formation, such toner can be melted with less calories and the consumed energy of the heater 40 can be suppressed, thereby achieving energy saving. In addition, the adhesive toner is preferably colorless, transparent toner without colorant. Use of colorless, transparent toner has a merit to make the adhesive toner image unnoticeable.

In addition, the exposure unit 26 is not necessarily provided. When the exposure unit 26 is not provided, the charger 25 causes a predetermined portion on the photoreceptor 21 to be charged with a polarity opposite the charged polarity of the toner, the toner is deposited on a charged area of the photoreceptor 21 by the developing device, and the adhesive toner image linearly extending in the main scanning direction is formed on the photoreceptor 21. The adhesive toner image is transferred onto the sheet and the adhesive toner image linearly extending in the main scanning direction is formed on the sheet.

The sheet on which the adhesive toner image has been transferred by the adhesive toner image forming unit 20 is conveyed to the sheet stacker 30 being a stacking means, and is stacked thereon. The sheet stacker 30 includes an alignment mechanism to jog and align a sheet bundle formed of a plurality of sheets stacked on the sheet stacker 30. The alignment mechanism includes a leading end stopper 31, a jogger fence, not shown, serving to jog the sheet in the width direction, a trailing end fence, not shown, serving to align a trailing end of the sheet, and the like. The jogger fence may be provided at one side only in which the sheets are pushed against a fixed fence at another side, or at both sides in which the jogger fences at both sides may sandwich the sheets. The sheet bundle is formed by aligning the plurality of sheets and unfixed adhesive toner images are formed on each sheet of the sheet bundle. The adhesive toner image forming unit 20 further includes a heater 40 as a heating means to attach adjacent sheets in the sheet bundle by fusing the unfixed adhesive toner images formed on each sheet of the sheet bundle.

The heater 40 is configured to be disposed opposite an uppermost sheet of the sheet bundle stacked on the sheet stacker and capable of being contacted against and withdrawn from the uppermost sheet.

Figure 3:
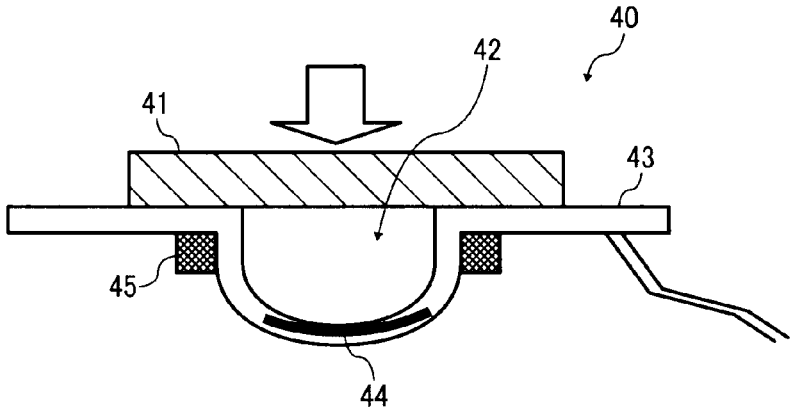
FIG. 3 is a general configuration of a heater.

FIG. 3 is a general configuration of the heater 40. As illustrated in FIG. 3, the heater 40 includes a base member 41 and a heat insulating member 42 having a curved surface which is opposite the sheet bundle. The heat insulating member 42 is fixed to the base member 41 with an adhesive. Examples of the materials for the heat insulating member 42 are glass or ceramics. On the heat insulating member 42, there is provided a sheet heat generator 43. The sheet heat generator 43 includes a heat generator 44 which is pattern-wired on a polyimide base and is fixed on the heat insulating member 42 with an adhesive and a securing ring 45.

Figure 4A:
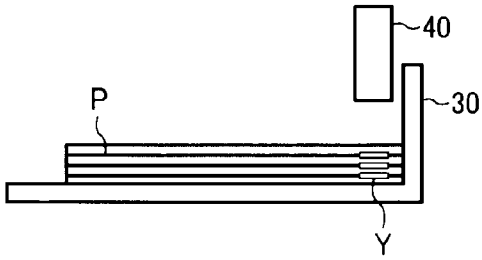
FIGS. 4A and 4B are explanatory views illustrating operation of the heater.
Figure 4B:
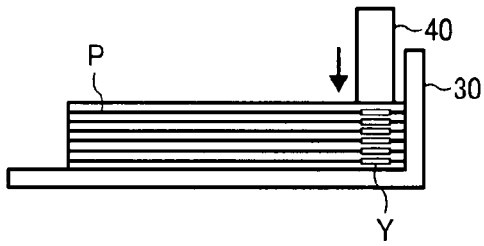
Figure 5:
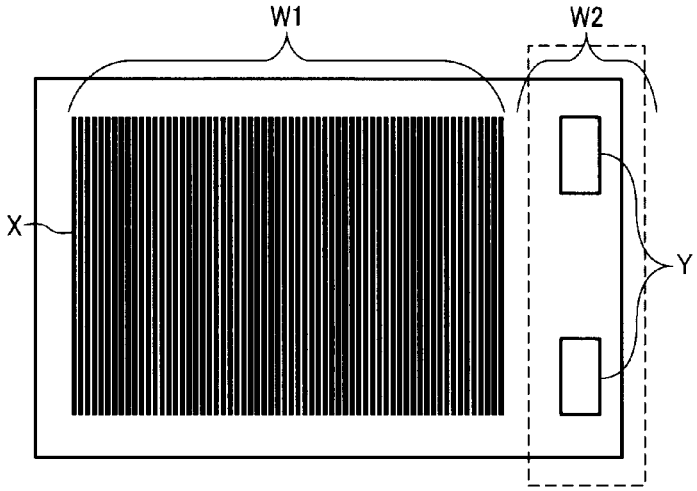
FIG. 5 is a view illustrating a pressing area of the heater relative to a bundle of sheets.

FIGS. 4A and 4B are views illustrating operation of the heater 40. As illustrated in FIGS. 4A and 4B, the heater 40 is disposed at a position opposite the adhesive toner images Y formed on the sheets below the uppermost sheet in the sheet bundle. Upon a number of sheets in the sheet bundle to be adhered having been stacked on the sheet stacker 30, current to heat the sheet heat generator 43 is applied to cause the heat generator 44 to generate heat. Next, the heater 40 is lowered, and as illustrated in FIG. 4B, the heater 40 is brought into contact with the uppermost sheet of the sheet bundle, and heats, while pressing, the sheet bundle. The heater 40 does not contact an image forming area W1 as illustrated in FIG. 5, and contacts and heats, while pressing, only an adhesive area W2 in which the adhesive toner image for the sheet bundle is formed. With such a structure, the adhesive toner image Y respectively formed on the sheets below the uppermost sheet is softened or fused, thereby attaching the adjacent sheets in the sheet bundle. After completion of adhesion, the heater 40 is separated from the sheet bundle to be moved to the position as illustrated in FIG. 4A.

In the present embodiment, the adhesive toner image on each sheet stacked on the sheet stacker 30 is not fixed, and therefore, it can adhere the adjacent sheets together more firmly compared to a case in which the adhesive toner image previously softened or melted by the fixing device 2 and fixed onto the sheet P is again softened or melted and used for adhering the adjacent sheets. With this structure, because the adhesive toner image alone can bind the sheet bundle, binding the sheet bundle in the present embodiment does not require any pin or needle used in, for example, binding the sheet bundle with a stapler. In addition, another advantage is that the sheet bundle bound in accordance with the present embodiment does not require removal of the pins or needles when recycling it.

In addition, the surface of the heater 40 opposing the sheet bundle is curved as illustrated in FIG. 3. Accordingly, the part in which the adhesive toner images Y of the sheet bundle are formed can be pressed with a high pressure. With this structure, because the adherence of the sheet P and the adhesive toner image Y can be increased the adjacent sheets of the sheet bundle can be attached together more firmly.

Figure 6:
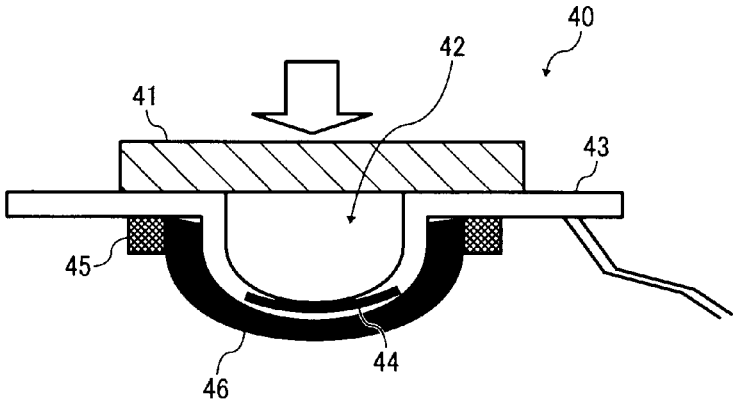
FIG. 6 is a general configuration of a modified example of the heater.
Figure 6:
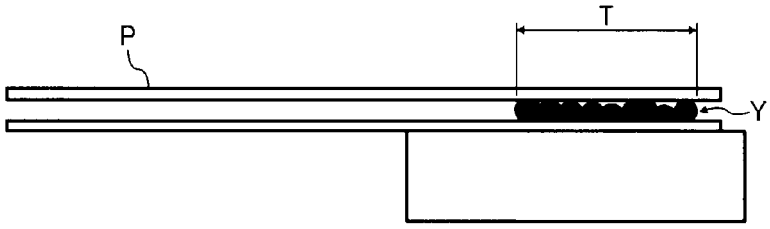

FIG. 6 is a general configuration of a modified example of the heater 40. The modified example of the heater 40 includes the sheet heat generator 43 and an elastic rubber member 46 formed on the sheet heat generator 43. The elastic rubber member 46 is formed of a heat-resistant and heat-conductive material such as silicon. By providing the elastic rubber member 46, distribution of pressure when the heater 40 presses the adhesive toner image forming area W2 is widened. Even though the length T of the adhesive toner image is long to a certain degree, the heat quantity from the heater 40 can be evenly distributed to the adhesive toner image. With this structure, the adhesive toner image can be uniformly melted, thereby obtaining an optimal adherence.

Figure 7:
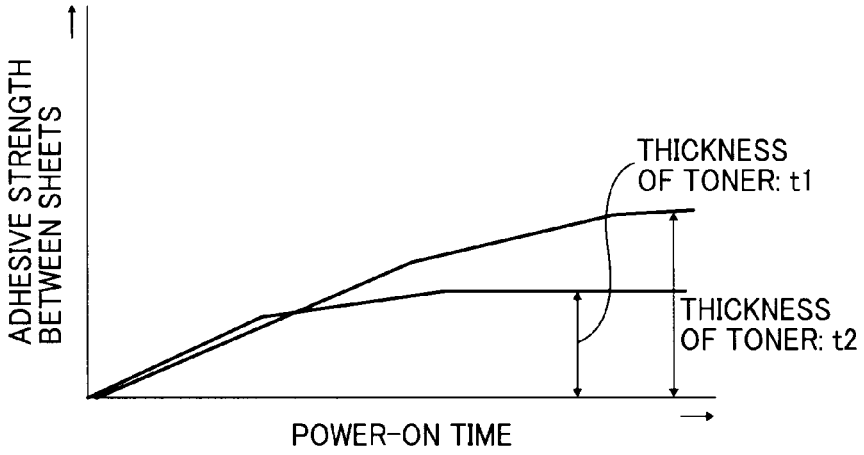
FIG. 7 is a graph showing a relation between the power-on time, thickness of the adhesive toner image, and adhesion strength between sheets.

FIG. 7 is a graph showing a relation between the power-on time to the heater 40, thickness of the adhesive toner image, and adhesion strength between sheets. As illustrated in the figure, it is noted that as the thickness of the adhesive toner image becomes larger or the deposit amount of the adhesive toner image per unit area becomes greater, the adhesion strength between sheets increases. In addition, as the power-on time to the heater 40 or the heat quantity to the adhesive toner image becomes larger, the adhesion strength between sheets increases. As described above, by changing the deposit amount of the adhesive toner image per unit area or the heat quantity applied to the adhesive toner image, the adhesion strength between sheets increases. For example, when each sheet is to be attached temporarily with a slight force, the deposit amount of the adhesive toner image may be lessened, or otherwise, the power-on time may be changed, so that the each sheet can be attached to each other slightly. Specifically, a mode of temporary attachment is provided so that a user can select the mode with an operation panel of the apparatus. Then, when the user selects and sets the temporary attachment mode, a controller, not shown, causes the deposit amount of the adhesive toner image per unit area to be lessened than the ordinary amount or the power-on time to the heater 40 to be shortened. Accordingly, the controller serves to change the adhesive amount and the heat quantity.

In addition, when the sheet for use in the present system is a thick sheet requiring a larger thermal capacity, the heat quantity necessary for fusing the adhesive toner image becomes different depending on the type of the sheet. Therefore, the controller of the present system may be configured to change the power-on time to the heater 40 based on the information concerning the type of the sheet for use in the apparatus. The sheet type information may be obtained by a user input on the sheet type information (for example, basis weight) when the user sets the sheet in a sheet container, not shown.

Further, in the present embodiment, the adhesive toner image is formed on either surface of the sheet on which image is formed in the image forming unit 10, but the adhesive toner image can be set to be formed on both sides of the sheet. Forming the adhesive toner image on both sides of the sheet may be realized by, for example, providing a second adhesive toner image forming unit which forms an adhesive toner image on a backside surface of the sheet. Alternatively, a reverse device is provided to guide a sheet which has passed through the adhesive toner image forming unit to the reverse device by a blanching plate. The reverse device reverses the sheet and gets the sheet returned between the fixing device and the adhesive toner image forming unit, and the adhesive toner image forming unit forms the adhesive toner image on the backside surface of the sheet, thereby implementing formation of the adhesive toner image on both sides of the sheet. Thus, forming the adhesive toner image on both sides of the sheet may increase the adhesive strength between sheets.

In addition, the adhesive toner image is formed on the leading end of the sheet, but may be formed on the trailing end of the sheet. Alternatively, the adhesive toner image may be formed at a predetermined position on the lateral side edge of the sheet.

Second Embodiment

Figure 8:
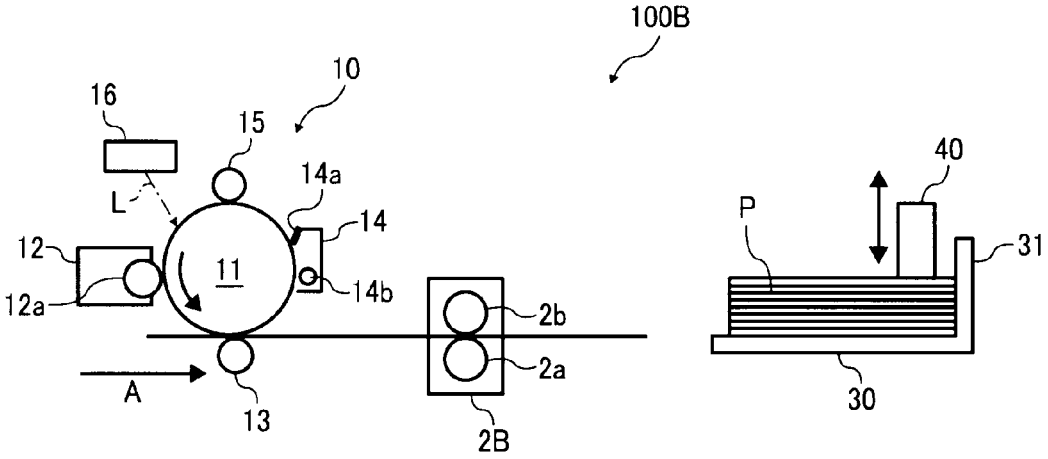
FIG. 8 is a general configuration of a bookbinding system according to a second embodiment of the present invention.

FIG. 8 is a general configuration of a bookbinding system according to a second embodiment of the present invention. The bookbinding system 100B according to the second embodiment is configured such that the adhesive toner image is formed by the image forming unit 10, and the adhesive toner image is prevented from being fixed on the sheet when the adhesive toner image formed by the image forming unit 10 passes through the fixing device.

Figure 9:
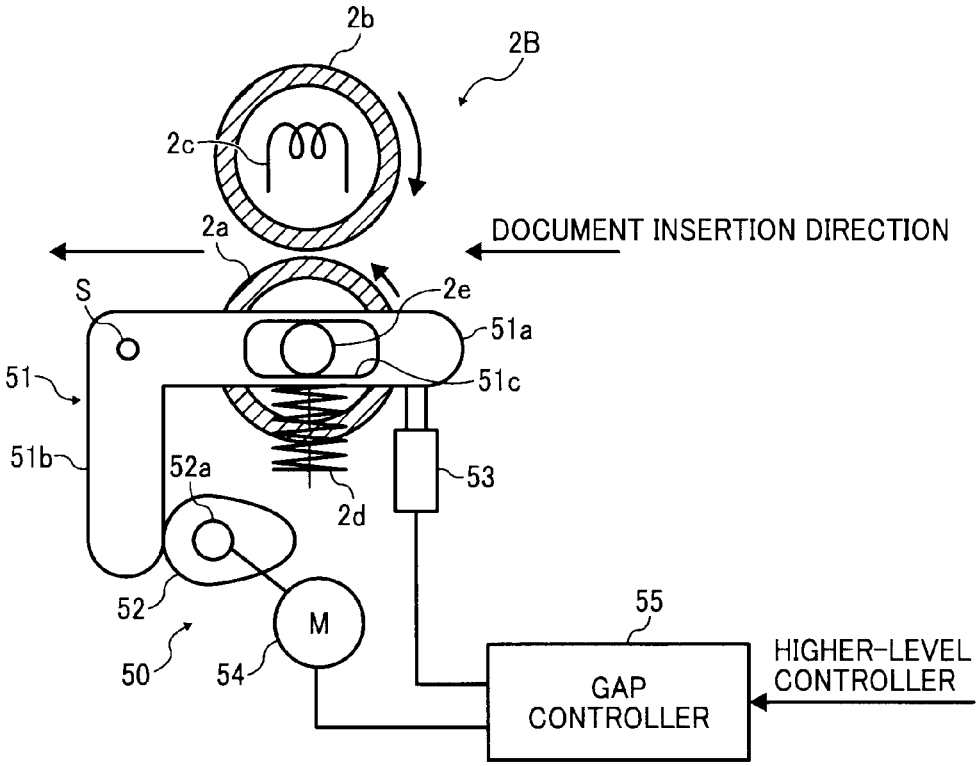
FIG. 9 is a general configuration of a heater related to the bookbinding system according to the second embodiment of the present invention.

FIG. 9 is a general configuration of a fixing device 2B for use in the bookbinding system 100B according to the second embodiment of the present invention. As illustrated in FIG. 9, the fixing device 2B includes a separation unit 50 to separate a pressure roller 2*a* from a heat roller 2*b*. The separation unit 50 includes an arm 51 and an eccentric cam 52 which contacts the arm 51 to cause the arm 51 to swing in a predetermined range. The arm 51 includes a parallel portion 51*a* extending in parallel in the sheet conveyance direction and a vertical portion 51*b* extending vertically with respect to the sheet surface. A support hole is formed at a point where the parallel portion 51*a* intersects the vertical portion 51*b* and the arm 51 is rotatably supported by a support shaft S mounted to the apparatus body. The parallel portion 51*a* includes a slot 51*c* that accommodates a rotation support shaft 2*e* of the pressure roller 2*a*. The eccentric cam 52 is disposed at a position contacting a side end surface of the vertical portion 51*b* of the arm 51 of a side nearer to the pressure roller 2*a*. A gap sensor 53 is attached to an end of the parallel portion 51*a* of the arm 51, and is connected with a gap controller 55.

Figure 10A:
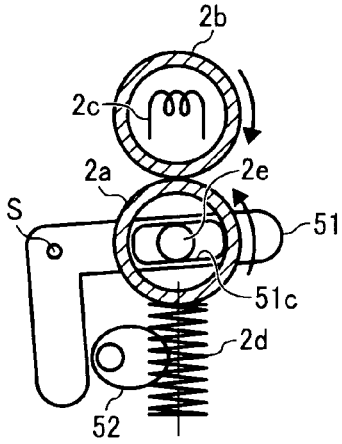
FIGS. 10A to 10C are views illustrating separating operation of a separation unit to separate a pressure roller from a heating roller.
Figure 10B:
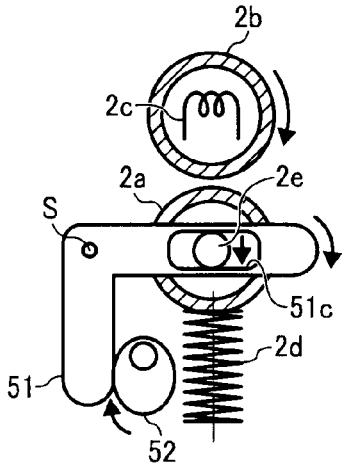
Figure 10C:
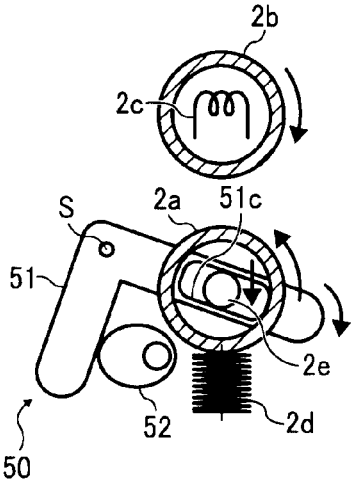

FIGS. 10A to 10C are views illustrating separating operation of the separation unit 50 to separate the pressure roller 2*a* from the heat roller 2*b*.

As illustrated in FIG. 10A, when the pressure roller 2*a* contacts the heat roller 2*b* with a predetermined pressure, the eccentric cam 52 is separated from the arm 51. In this case, the pressure roller 2*a* contacts the heat roller 2*b* with a predetermined contact pressure by a coil spring 2*d*, a means to press the pressure roller 2*a* toward the heat roller 2*b*. As illustrated in FIGS. 10B and 10C, when the eccentric can 52 is caused to contact the arm 51, the arm 51 rotates in the clockwise direction in the figure against the biasing force of the coil spring 2*d*, thereby separating the pressure roller 2*a* from the heat roller 2*b*. In addition, by adjusting the rotation angle of the eccentric cam 52, the contact pressure of the pressure roller 2*a* against the heat roller 2*b* can be controlled. Specifically, the gap sensor 53 detects a gap between the gap sensor 53 and the arm 51, the gap controller 55 controls a cam motor 54 based on the detection result of the gap sensor 53, whereby the contact pressure of the pressure roller 2*a* against the heat roller 2*b* can be controlled. Accordingly, the contact pressure of the pressure roller 2*a* against the heat roller 2*b* can be controlled based on the type of the sheet, and the like, and therefore, the image formed on the sheet can be fixed with an optimal fixing condition based on the type of the sheet.

Figure 11:
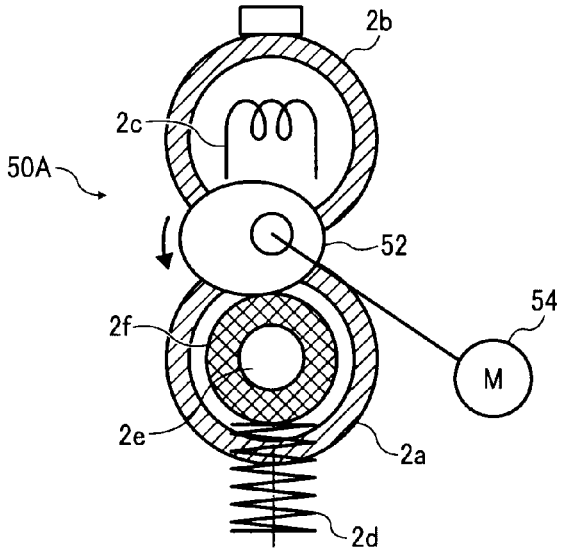
FIG. 11 is a modified example of the separation unit.
Figure 12:
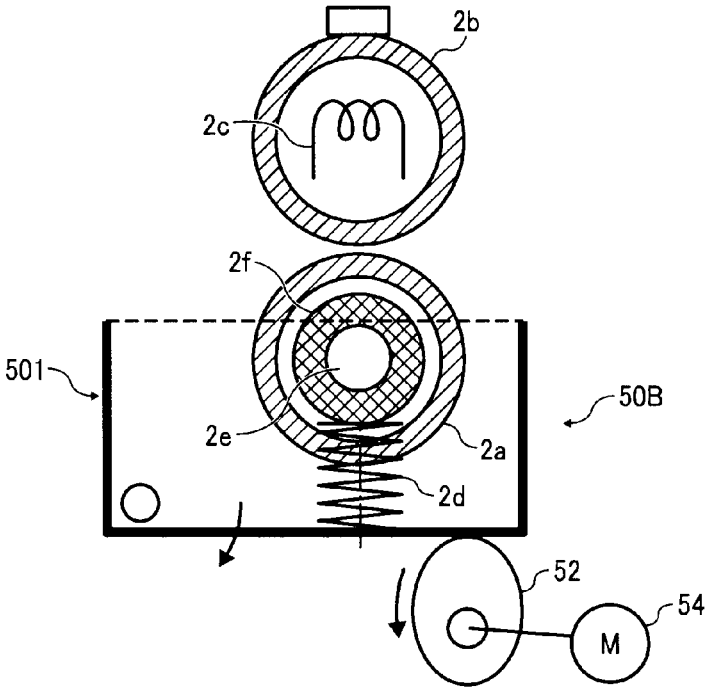
FIG. 12 is another modified example of the separation unit.

FIG. 11 shows another configuration of the separation unit 50. As illustrated in FIG. 11, a shaft bearing 2*f* supports a rotation support shaft 2*e* of the pressure roller 2*a* and contacts a coil spring 2*d*, and the eccentric cam 52 contacts the shaft bearing 2*f* at a position opposite the contacting portion between the shaft bearing 2*f* and the coil spring 2*d*. And the eccentric cam 52 pushes the pressure roller 2*a* in a direction opposite the biasing direction of the coil spring 2*d*. FIG. 12 shows further another example of the separation unit 50. As illustrated in FIG. 12, the pressure roller 2*a* and the coil spring 2*d* are integrally formed to be a single unit 501 which is swingably supported to the apparatus body, and a portion opposite a support portion of the apparatus body is supported by the eccentric cam 52. Thus, the integral unit 501 including the pressure roller 2*a* and the coil spring 2*d* is swingably supported by the eccentric cam 52, thereby separating the pressure roller 2*a* from the heat roller 2*b*.

Figure 13:
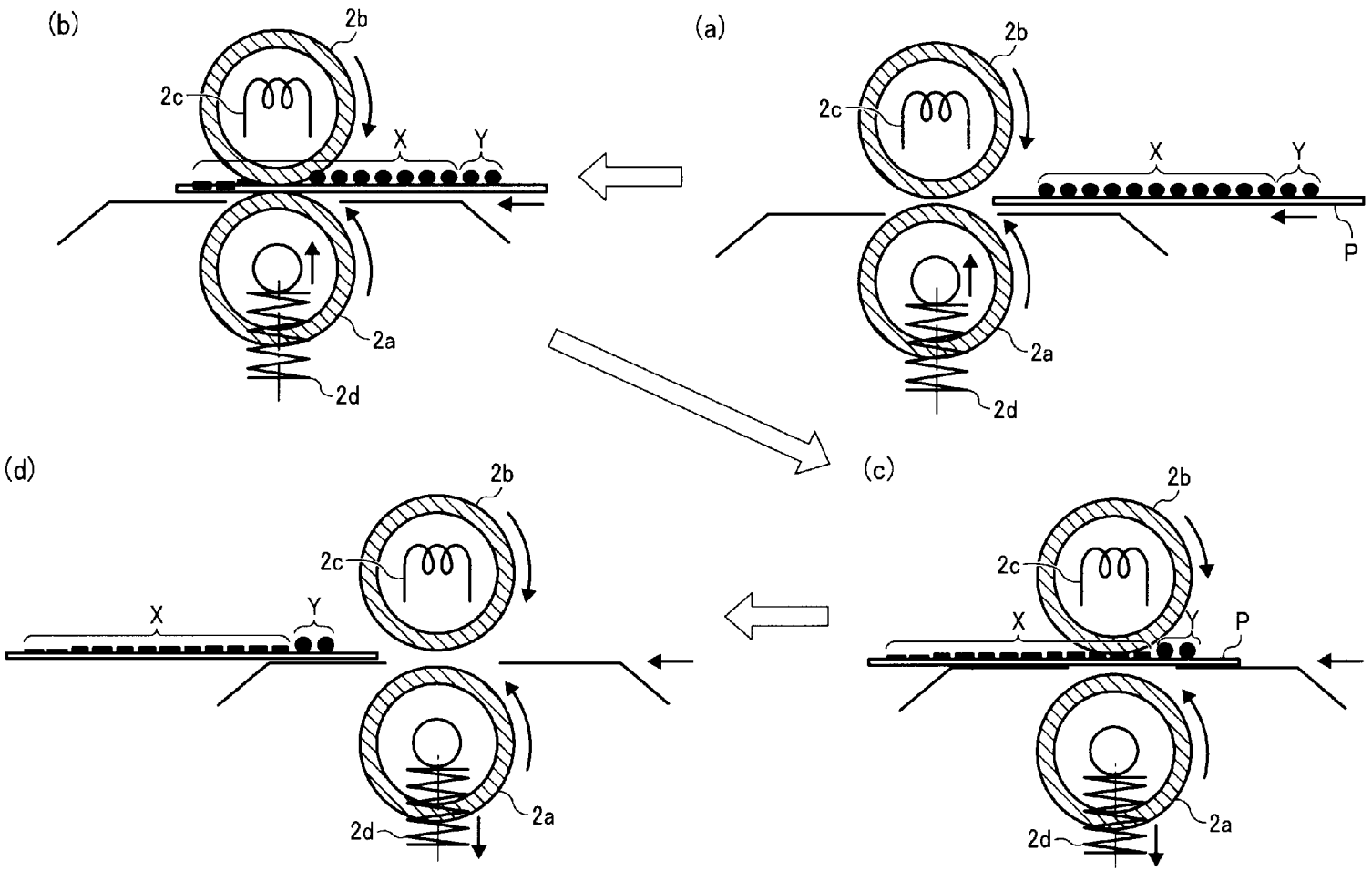
FIGS. 13(*a*) through 13(*d*) are views illustrating operation when a sheet on which a toner image and an adhesive toner image are transferred passes through a fixing nip.

FIGS. 13(*a*) to 13(*d*) are views each illustrating an operation of a sheet P on which toner images X and adhesive toner images Y are transferred passing through a fixing nip of the fixing device 2B. In the explanation of FIGS. 13(*a*) to 13(*d*), it is noted that the adhesive toner image Y is formed on the trailing end of the sheet P.

As illustrated in FIG. 13(*a*), the leading end of the sheet includes a regular image, and therefore, the pressure roller 2*a* is kept contacting the heat roller 2*b* with a predetermined pressure. Then, as illustrated in FIG. 13(*b*), the sheet P is conveyed to the fixing nip to cause the toner image X on the sheet to be heated and fixed onto the sheet P.

As illustrated in FIG. 13(*c*), upon the trailing end of the toner image X on the sheet passing through the fixing nip, the separation unit 50 is operated to cause the pressure roller 2*a* to start to be separated from the heat roller 2*b*. Accordingly, when the adhesive toner image Y reaches the fixing position, the pressure roller 2*a* is separated from the heat roller 2*b*. As a result, as illustrated in FIG. 13(*d*), the adhesive toner image Y on the sheet P passes through the fixing device 2B without being sandwiched at the fixing nip. Thus, the adhesive toner image Y is not pressed nor heated in the fixing device 2B and passes through the fixing device 2B in the non-fixed state. As a result, the adhesive toner image Y in the non-fixed state is conveyed to the sheet stacker 30 and is stacked there. Thereafter, similarly to the case of the first embodiment, when a set of sheet bundle to be adhered is stacked on the sheet stacker 30, the heater 40 is caused to contact the adhesive toner image forming area of the sheet bundle so that the unfixed adhesive toner image Y is pressed and heated and adjacent sheets are adhered to each other.

In the bookbinding system 100B according to the second embodiment, there is no need of the adhesive toner image forming unit downstream the fixing device, thereby achieving space saving. In addition, in the ordinary image forming apparatus, a bookbinding system to perform a coherent process from the image formation to the bookbinding easily may be provided by replacing the fixing device 2 and mounting the heater 40 to a discharged sheet stocker alone.

Figure 14:
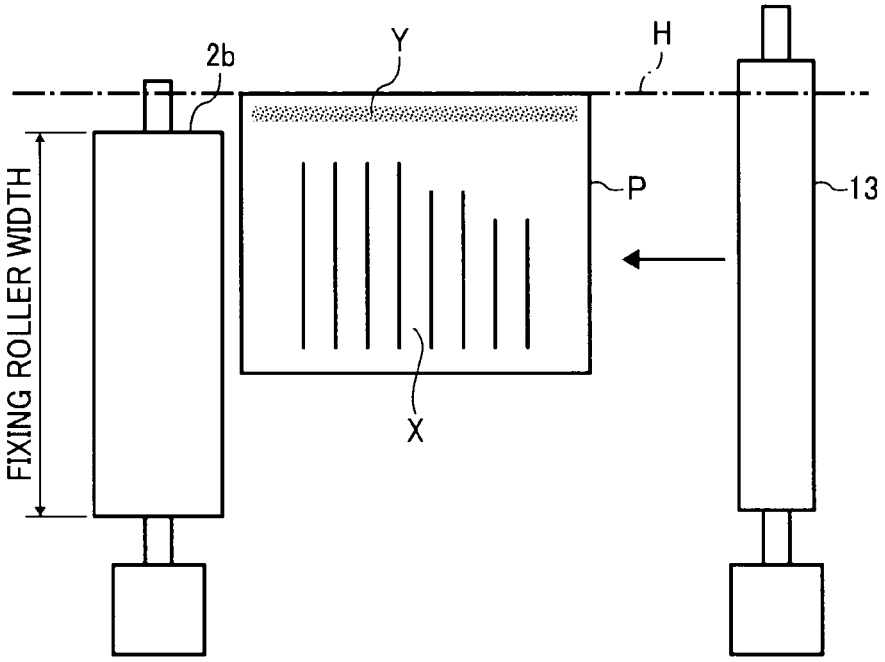
FIG. 14 is a modified example of a bookbinding system according to the second embodiment of the present invention.

FIG. 14 is a modified example of the bookbinding system 100B according to the second embodiment. In the modified example as illustrated in FIG. 14, the adhesive toner image is not fixed to the sheet because the adhesive toner image Y is formed at an edge portion extending in the sheet conveyance direction of the sheet P and the adhesive toner image Y passes an area outside the fixing nip.

In this modified example, a sheet conveyance reference H resides at one side (upper in the figure) in the main scanning direction and the sheet is conveyed with an end of the sheet main scanning direction aligned with this conveyance reference H. An edge of the heat roller 2*b* in the main scanning direction (upper side in the figure) is disposed apart from the conveyance reference H toward another end in the main scanning direction (lower side in the figure). With this structure, the edge of sheet at one end in the main scanning direction (upper side in the figure) passes outside the fixing nip, in which the sheet passes the fixing device without being heated or pressed at the fixing nip. As a result, the adhesive toner image formed at an edge portion extending in the main scanning direction of the sheet passes through the fixing nip in the non-fixed state.

The structure to separate the pressure roller 2*a* from the heat roller 2*b* had a disadvantage. When the adhesive toner image passes through the fixing position, the pressing force of the pressure roller 2*a* applied to the toner image formed near the area in which the adhesive toner image is formed decreases, thereby degrading the fixing ability. In the present modified example, because the pressure roller 2*a* need not be separated from the heat roller 2*b* when the adhesive toner image passes through the fixing position. Therefore, the toner image on the sheet can be optimally fixed onto the sheet.

Third Embodiment

Figure 15:
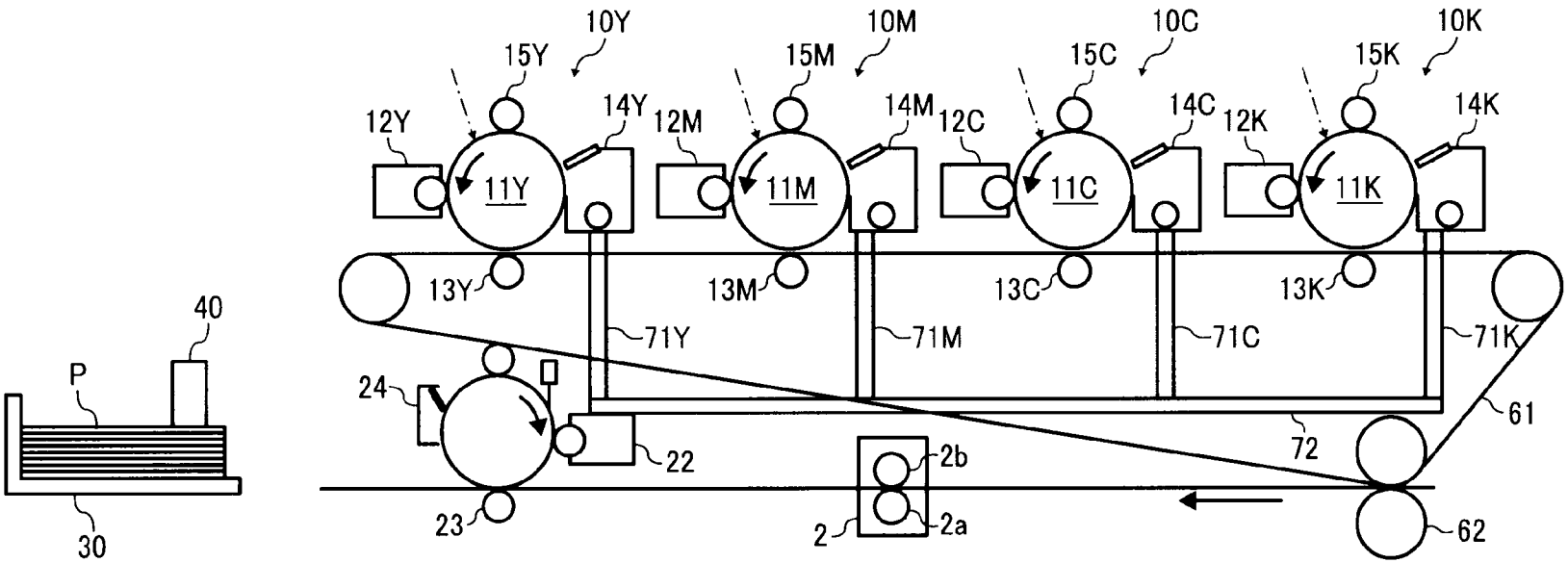
FIG. 15 is a general configuration of a bookbinding system according to a third embodiment of the present invention.

FIG. 15 is a general configuration of a bookbinding system 100C according to a third embodiment of the present invention. The bookbinding system 100C according to the third embodiment employs waste toner which is not used in the image forming unit 10 and collected.

The image forming method according to the third embodiment is a so-called tandem type image forming method, in which a plurality of image forming units are laterally disposed, a single-color toner image is formed on each photoreceptor, and the single-color toner images are sequentially transferred on an intermediate transfer body to form a synthesized color image. Four image forming units 10Y, 10C, 10M, and 10K each configured to form an image of a corresponding color of yellow, cyan, magenta, and black are disposed in this order of colors from left to right. Herein, an affix of Y, C, M and K of each reference numeral represents being a part or component of yellow, cyan, magenta, and black, respectively. Each image forming unit 10Y to 10K has a similar configuration as that of the image forming unit 10 according to the first embodiment. The exposure unit is not necessarily provided to each image forming unit. With one exposure unit of opposite scanning type alone, a latent image can be formed on each photoreceptor 11Y to 11K.

In addition, directly below the tandem image forming unit, an endless belt-shaped intermediate transfer belt 61 is provided as an intermediate transfer body. This intermediate transfer belt 61 rotatably moves in the clockwise direction in the figure. Each of primary transfer units 13Y, 13C, 13M, and 13K is disposed inside the intermediate transfer belt 61 and transfers a toner image formed on each of the photoreceptors 11Y, 11C, 11M, and 11K onto the intermediate transfer belt 61. A secondary transfer device 62 is disposed downstream of the primary transfer units 13Y, 13C, 13M, and 13K in the driving direction of the intermediate transfer belt 61.

A single-color toner image of yellow, cyan, magenta, and black is formed respectively on each of the photoreceptors 11Y, 11C, 11M, and 11K. While the intermediate transfer belt 61 rotating, the single-color toner image is sequentially transferred onto the intermediate transfer belt 61 by each of the primary transfer devices 13Y, 13C, 13M, and 13K, thereby forming a synthesized color image on the intermediate transfer belt 61. In sync with the image formation, a sheet is conveyed from a sheet feed cassette, not shown, to a registration roller, not shown, and is stopped once. At a matched timing with the image formation, the sheet is conveyed to a portion between the secondary transfer device 62 and the intermediate transfer belt 61. Here, the intermediate transfer belt 61 and the secondary transfer device 62 form a secondary transfer nip to sandwich the sheet in between, so that the toner image on the intermediate transfer belt 61 is secondarily transferred on the sheet.

Figure 16:
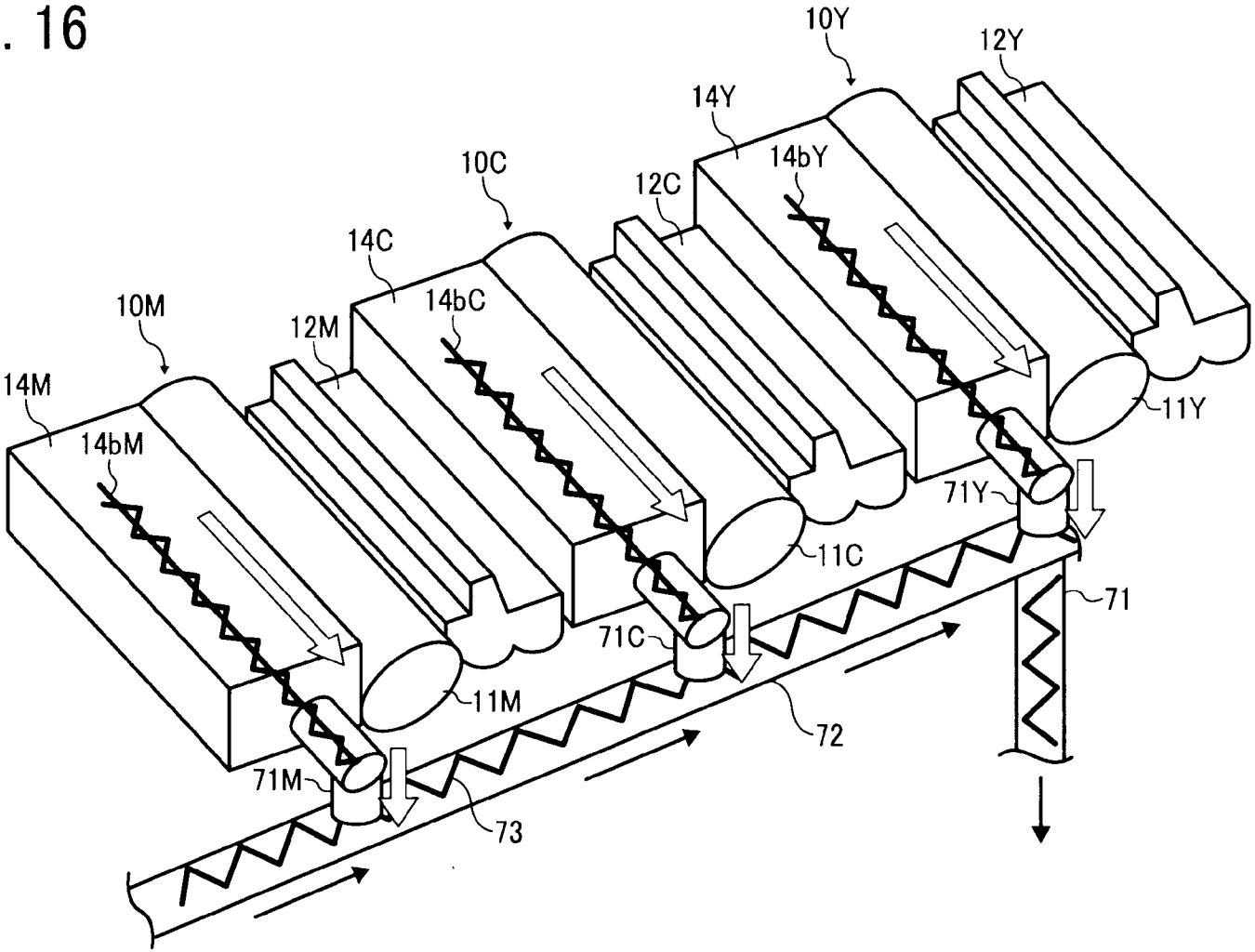
FIG. 16 is an oblique view illustrating an image forming unit and a waste toner conveyance path.

FIG. 16 is a perspective view illustrating an image forming unit and a waste toner conveyance path 71 seen from a direction opposite the direction in FIG. 15 and shows the image forming units 10Y, 10C, and 10M.

As illustrated in FIG. 16, each waste toner conveyance path 71Y, 71C, 71M, and 71K is connected with a lower part of each cleaning device 14Y to 14K of the image forming unit 10Y to 10K. Each screw-shaped toner conveyor 14*b*Y to 14*b*K which extends up to an inlet of the waste toner conveyance path is disposed at a bottom of each cleaning device 14Y to 14K (14K is not shown in the figure).

The waste toner conveyance path 71Y to 71K of each color connects a joint waste toner conveyance path 72, which further connects a developing device of the adhesive toner image forming unit 20. A conveyance screw 73 is provided inside the joint waste toner conveyance path 72. Each conveyance screw 73 is capable of sending a set amount of toner per unit time. In the present embodiment, the waste toner conveyance path is joined, being issued from the cleaning device for each color, into one single path to communicate with a developing device 22 of an adhesive toner image forming unit 20. However, a plurality of waste toner conveyance paths may be provided for each toner color, and each path may be communicated with the developing device 22 of the adhesive toner image forming unit 20. Alternatively, a second waste toner conveyance path to communicate the cleaning device 24 of the adhesive toner image forming unit 20 and the developing device 22 of the adhesive toner image forming unit 20 is provided, and the collected toner may be conveyed to the developing device 22 of the adhesive toner image forming unit 20 with use of the cleaning device 24 of the adhesive toner image forming unit 20. Further alternatively, a third waste toner conveyance path to communicate an intermediate transfer cleaning device, not shown, to clean the residual toner after a secondary transfer deposited on the intermediate transfer belt 61 and the developing device 22 of the adhesive toner image forming unit 20 is provided, and the collected waste toner may be conveyed to the developing device 20 of the adhesive toner image forming unit 20.

The waste toner is stored in the developing device 22 of the adhesive toner image forming unit, the adhesive toner image forming unit forms an adhesive toner image on the photoreceptor 21 using the waste toner, and the adhesive toner image formed of the waste toner is transferred to a predetermined edge portion of the sheet (which becomes a spine binding portion of a complete booklet).

The waste toner collected from each image forming unit 10Y to 10K is difficult to be reused for a toner image because of mixed colors and electrically-charged amount, but the adhesive toner image is formed inside the sheet bundle (that is, a bound portion in the complete booklet) and cannot be seen from outside. Further, because the deposition amount of the adhesive toner image need not be controlled so strictly compared to the toner image, no problem would occur even when the waste toner is used for the adhesive toner image. In the third embodiment, because the adhesive toner image is formed using the waste toner collected in each image forming unit 10Y to 10K, the waste toner amount can be reduced and effectively reused.

Fourth Embodiment

Figure 17:
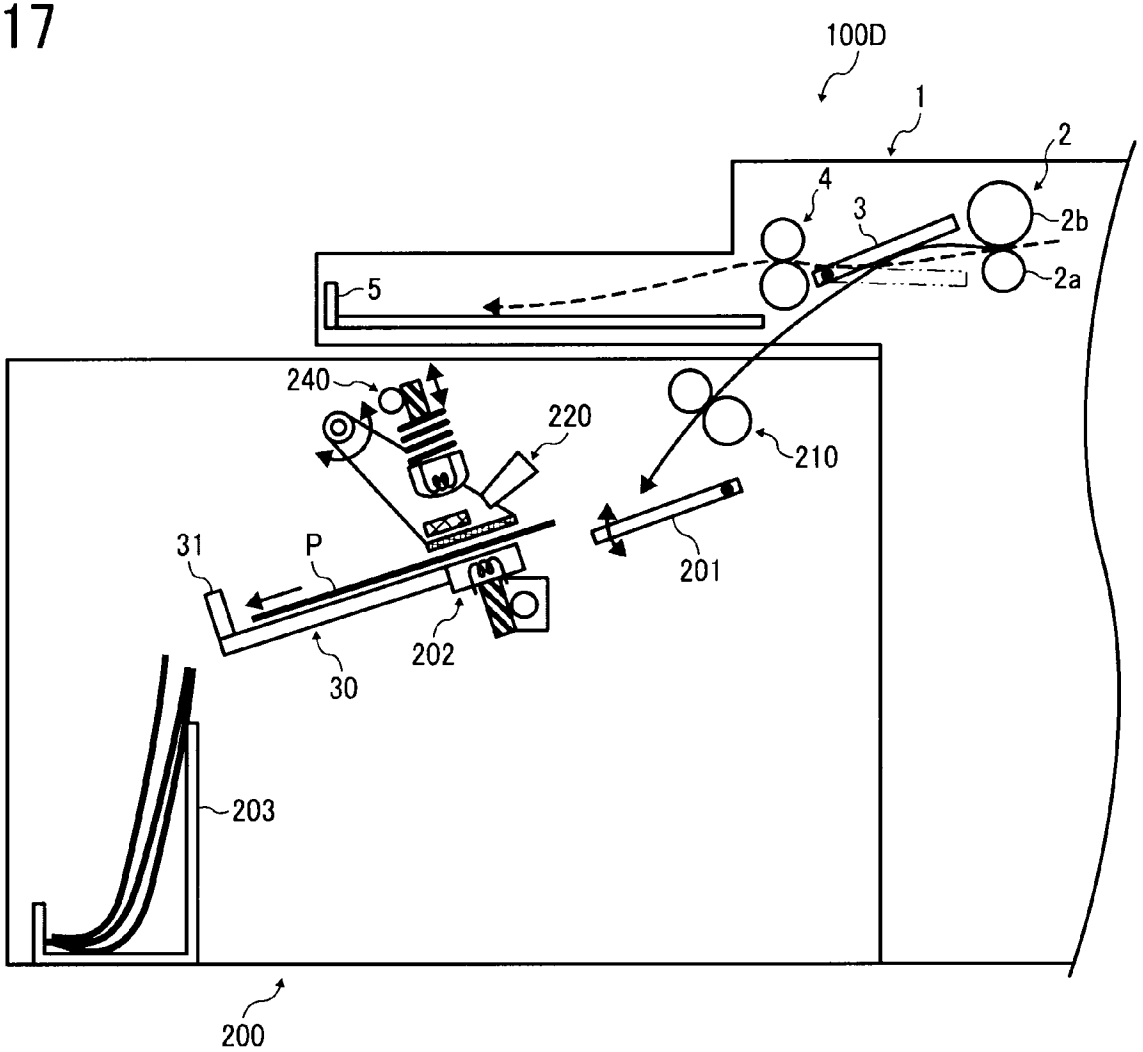
FIG. 17 is a general configuration of a main part of a bookbinding system according to a fourth embodiment of the present invention.

FIG. 17 is a general configuration of a main part of a bookbinding system 100D according to a fourth embodiment of the present invention. The bookbinding system 100D according to the fourth embodiment includes an adhesive toner image forming unit disposed at the sheet stacker 30.

As illustrated in FIG. 17, the bookbinding system 100D according to the fourth embodiment includes a binder 200 as a post processor separately from the image forming apparatus 1.

The sheet on which a toner image is transferred in the image forming unit 10, not illustrated in FIG. 17, mounted in the image forming apparatus 1 passes through the fixing device 2, the toner image is fixed thereon, and the sheet is conveyed to a discharged sheet switcher 3. When a predetermined number of sheets are bound to be a book, the discharged sheet switcher 3 is positioned at a position indicated by a solid line in the figure. With this structure, the sheet that has passed through the fixing device 2 is conveyed to the binder 200. On the other hand, if the binding process is not performed, the discharged sheet switcher 3 is moved to a position indicated by a dotted line in the figure. With this structure, the sheet that has passed through the fixing device 2 is conveyed to a discharged sheet tray 5 via a sheet discharge roller pair 4.

Figure 18:
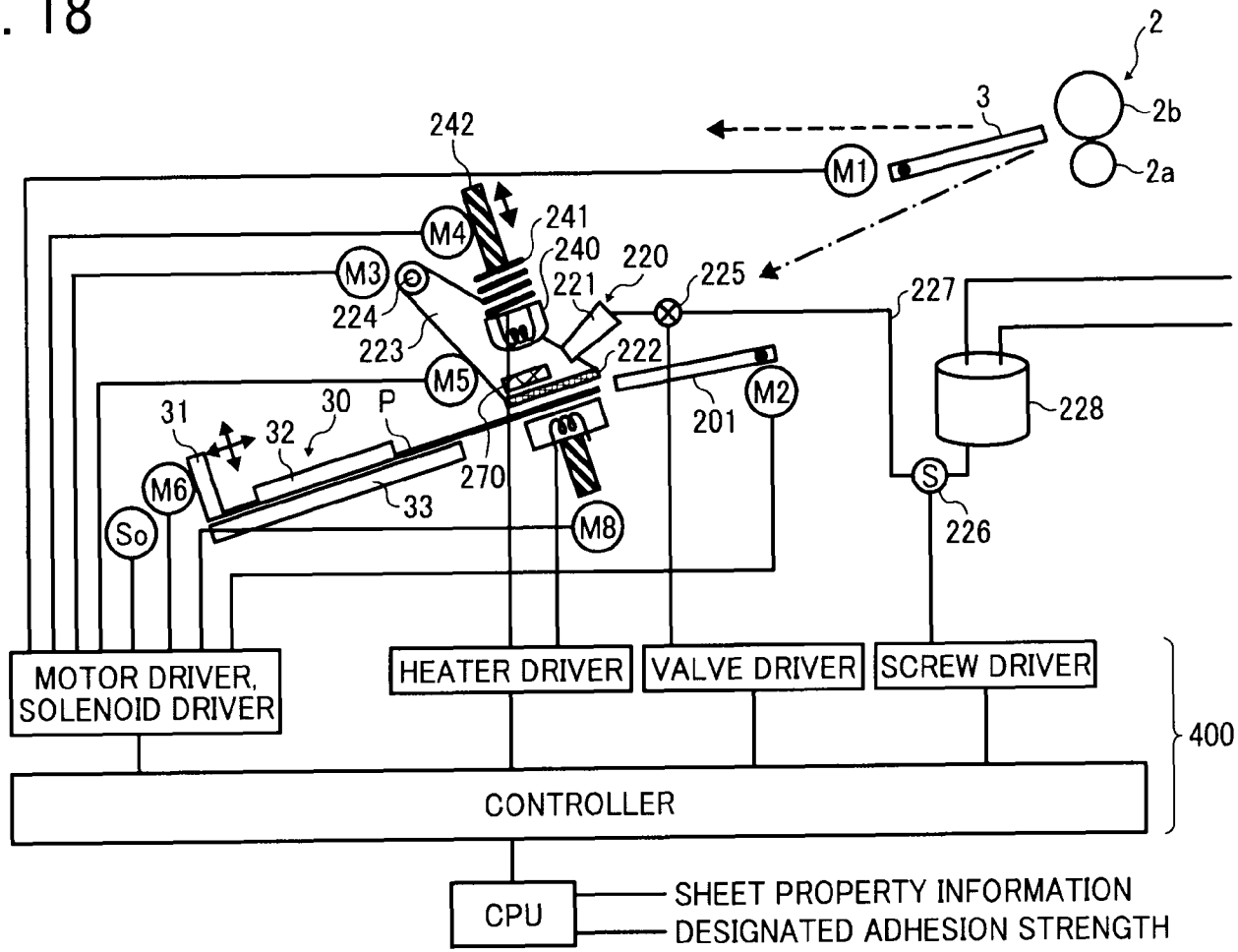
FIG. 18 is a general configuration of a main part of a binding device.

FIG. 18 is a general configuration of a main part of the binder 200. As illustrated in FIG. 18, the binder 200 includes a sheet stacker 30 to form a sheet bundle, an adhesive toner image forming unit 220 to form adhesive toner images at a trailing end portion of the sheet stacked on the sheet stacker 30, and a heater 240 to heat the adhesive toner images formed on the trailing end of the sheet.

The sheet stacker 30 includes, similarly to the first embodiment, a jogging and alignment function to align the sheet bundle including a plurality of sheets stacked on the sheet stacker 30. The alignment function is exerted by a leading end stopper 31 to stop the leading end of the sheet conveyed to the sheet stacker 30 and a jogger fence 32 serving to jog the sheet in the width direction. In addition, in the present embodiment, the downstream side of the sheet stacker 30 in the sheet conveyance direction is vertically below the upstream side of the sheet stacker 30, so that the sheet that has conveyed to the sheet stacker 30 contacts the leading end stopper 31 with its own weight. This structure eliminates the need for the trailing end fence to align the trailing end of the sheet, reduces the number of parts, and makes the entire apparatus inexpensive.

Figure 19:
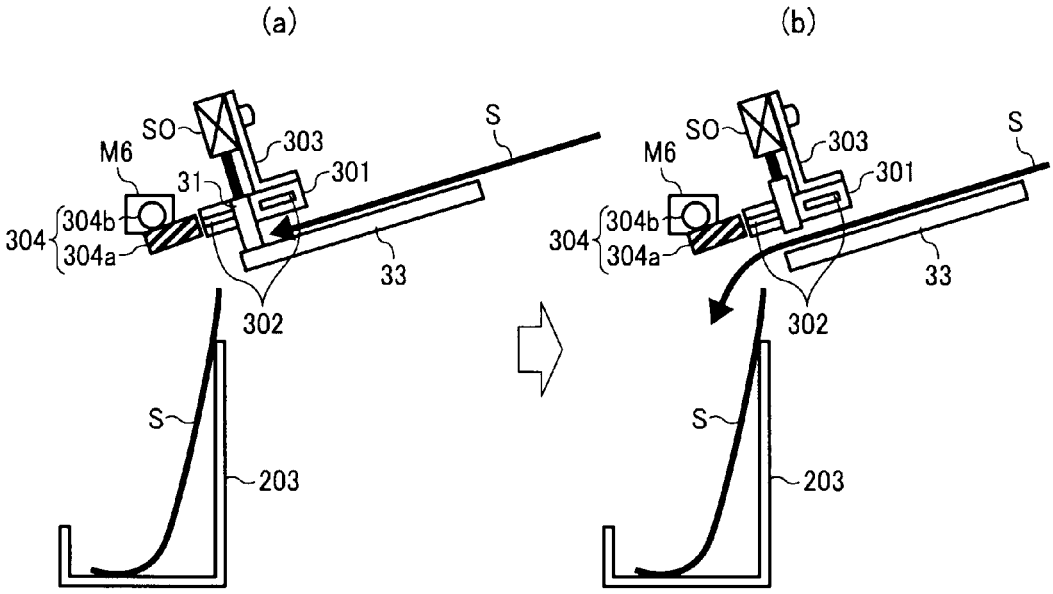
FIGS. 19(*a*) and 19(*b*) are views illustrating a main part around a leading end stopper.

FIG. 19 is a general configuration of a main part around the leading end stopper 31. As illustrated in FIG. 19, a stopper table 301 is so supported as to be movable in the sheet conveyance direction by guide rollers 302 disposed at both lateral ends in the main scanning direction, and the leading end stopper 31 is supported to the stopper table 301 so as to be movable in a direction perpendicular to the conveyed sheet surface. One end of a position adjustment screw gear 304*a* of a position adjustment worm gear 304 contacts a downstream end of the stopper table 301 in the sheet conveyance direction. A helical gear 304*b* of the position adjustment worm gear 304 is fixed to a driving shaft of a stopper motor M6. Further, an open/close solenoid SO is fixed to an upper surface of the leading end stopper 31. The solenoid SO is mounted to the stopper table 301 via a solenoid holder 303. As illustrated in FIG. 18, the open/close solenoid SO and the stopper motor M6 are connected to a motor driver and a solenoid driver, respectively.

When the stopper motor M6 is driven, the helical gear 304*b* is driven to rotate and the screw gear 304*a* is moved to the sheet conveyance direction. As a result, together with the stopper table 31 contacting the screw gear 304*a*, the leading end stopper 31 moves toward the sheet conveyance direction. Specifically, a CPU receives sheet size data transmitted from the image forming apparatus to the sheet stacker 30 and sends a control signal corresponding to the sheet size data to a controller. Based on the control signal, the controller controls the stopper motor M6 via the motor driver and causes the leading end stopper 31 to move to a predetermined position. Accordingly, the trailing end of the sheet on the sheet stacker 30 stopped by the leading end stopper 31 is allowed to face the heater 240 and an opening of a toner regulation plate 222, to be described later, of the adhesive toner image forming unit 220.

When a predetermined number of sheets for a sheet bundle to be bound have been stacked on the sheet stacker 30 and a trailing end of the sheet bundle is bound into a complete book S, the open/close solenoid SO is driven and the leading end stopper 31 is raised upward as illustrated in FIG. 19(*b*). Then, the book S on the sheet stacker 30 slides down from the sheet stacker 30 with its own weight and is discharged to a stacker 203. Upon the book being discharged to the stacker 203, the open/close solenoid SO is turned off, so that the leading stopper 31 is caused to contact a loading plate 33. The loading plate 33 serves to load sheets on the sheet stacker 30.

Figure 20:
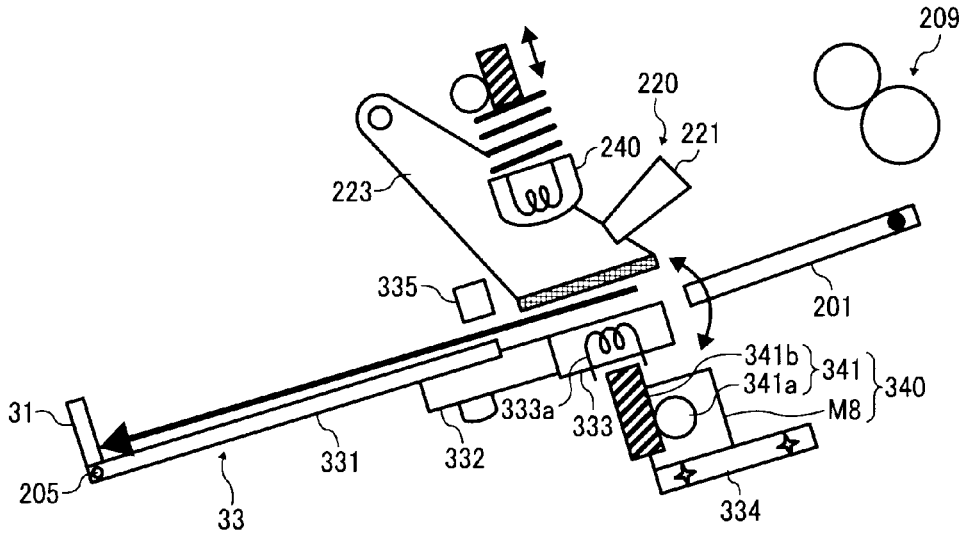
FIG. 20 is an enlarged view illustrating the part around the sheet stacker.

Further, as illustrated in FIG. 20, the loading plate 33 includes a sheet table 331 and a heating plate 333, an auxiliary heater, including a built-in heat source 333*a* such as a halogen lamp. The heating plate 333 is fixed to an upstream end of the sheet table 331 in the sheet conveyance direction via a connection plate 332 having thermal insulation property. When the number of the sheets of the sheet bundle stacked on the sheet stacker 30 increases, the thermal capacity of the sheet bundle increases and the adhesive toner image won't be fused easily. Then, when a predetermined number of sheets are stacked on the sheet stacker 30, the heat source 333*a* of the heating plate 333 is turned on to auxiliary heat the sheet bundle from the lower part thereof to accelerate fusing of the adhesive toner image by the heater 240. The upstream end of the sheet table 331 in the sheet conveyance direction is rotatably supported to a supporting shaft 205 of the adhesive toner image forming unit 220.

A loading plate lifting unit 340, serving to attach and detach the loading plate 33 to and from the adhesive toner image forming unit 220 is disposed below the heating plate 333. The lifting unit 340 includes a lifting worm gear 341 and a lifting motor M8. An end of a screw gear 341*a* of the lifting worm gear 341 contacts a bottom surface of the heating plate 333, thereby supporting the loading plate 33. A helical gear 341*b* of the lifting worm gear 341 engaging with the screw gear 341*a* is fixed to a driving shaft of the lifting motor M8. The lifting motor M8 is fixed to a frame 334 which serves to fix the motor and is mounted to the apparatus body. By driving the lifting motor M8, the screw gear 341*a* of the lifting worm gear 341 moves vertically and the loading plate 33 rotates about the supporting shaft 205 of the unit 220. A sensor 335 to detect a sheet surface position is disposed at a predetermined position opposite an uppermost sheet of the sheet bundle stacked on the sheet stacker 30. This sensor 335 is movable and detects a distance from the uppermost sheet of the sheet bundle to the sensor itself.

The loading plate lifting unit 340 is configured to be driven so that the distance between the sheet surface position detection sensor 335 and the uppermost sheet of the sheet bundle becomes constant based on the detection result of the sensor 335. Then, the loading plate 33 rotates about the supporting shaft 205 of the unit 220 and is lifted or lowered. With this structure, because the distance between the sheet surface position detection sensor 335 and the uppermost sheet of the sheet bundle of the sheet stacker 30 can be maintained to be constant, the adhesive toner image can be formed on the sheet stably. Further, the supporting point of the rotation of the loading plate 33 is sufficiently apart from the adhesive toner image forming unit 220. With this structure, even though the loading plate 33 is lowered, an angle formed by an opening surface of the opening of a toner regulation plate (to be described later) and the uppermost sheet of the sheet bundle loaded on the sheet stacker 30 is prevented from changing greatly. With this structure, the position to form an adhesive toner image can be prevented from shifting drastically.

As illustrated in FIG. 18, the adhesive toner image forming unit 220 includes a toner supply nozzle 221 and a toner regulation plate 222. The toner regulation plate 222 is disposed between the toner supply nozzle 221 and the sheet P and regulates deposition of the waste toner discharged from the toner supply nozzle 221 to the sheet. The toner supply nozzle 221 is connected with a waste toner bottle 228 to reserve the waste toner collected from the image forming unit 10 via a waste toner supply path 227. A conveyance screw is provided to the waste toner supply path 227. A shutter valve 225 is disposed in the vicinity of the toner supply nozzle 221 of the waste toner supply path 227. Normally, the shutter valve 225 is closed and the toner supply nozzle 221 is closed. When the waste toner is to be supplied, a solenoid to open/close the shutter valve 225 is turned on and the shutter valve 225 is open. Then, a conveyance screw provided in the waste toner supply path 227 is driven to rotate. When the conveyance screw is rotated once, the waste toner filled in a lead of the screw is discharged from the toner supply nozzle 221. When the conveyance screw is rotated twice, a double amount of waste toner is discharged so that the amount to be discharged is proportional to the number of rotation of the screw. Then, when discharge of waste toner is complete, the shutter valve 225 is closed again.

The toner supply nozzle 221 discharges the waste toner supplied from the waste toner reservoir to a trailing end of the sheet so that the adhesive toner image is formed on the trailing end of the sheet. The present embodiment differs from the aforementioned first to third embodiments on a point that the image forming apparatus forms an adhesive toner image without using the electrophotographic method. Accordingly, the waste toner can be attached to the sheet by an uncomplicated method in which the toner is sequentially moved by a rotation of the screw inserted in a pipe. Further, the toner can be flexibly moved by a tube alone from the image forming apparatus to the post processor using an open space. Therefore, compared to the case in which the adhesive toner image is formed using the electrophotographic method, the adhesive toner image forming unit 220 is structurally simplified and space saving is achieved. Further, because the charger is not used, energy saving is achieved compared to the electrophotographic method.

Figure 21:
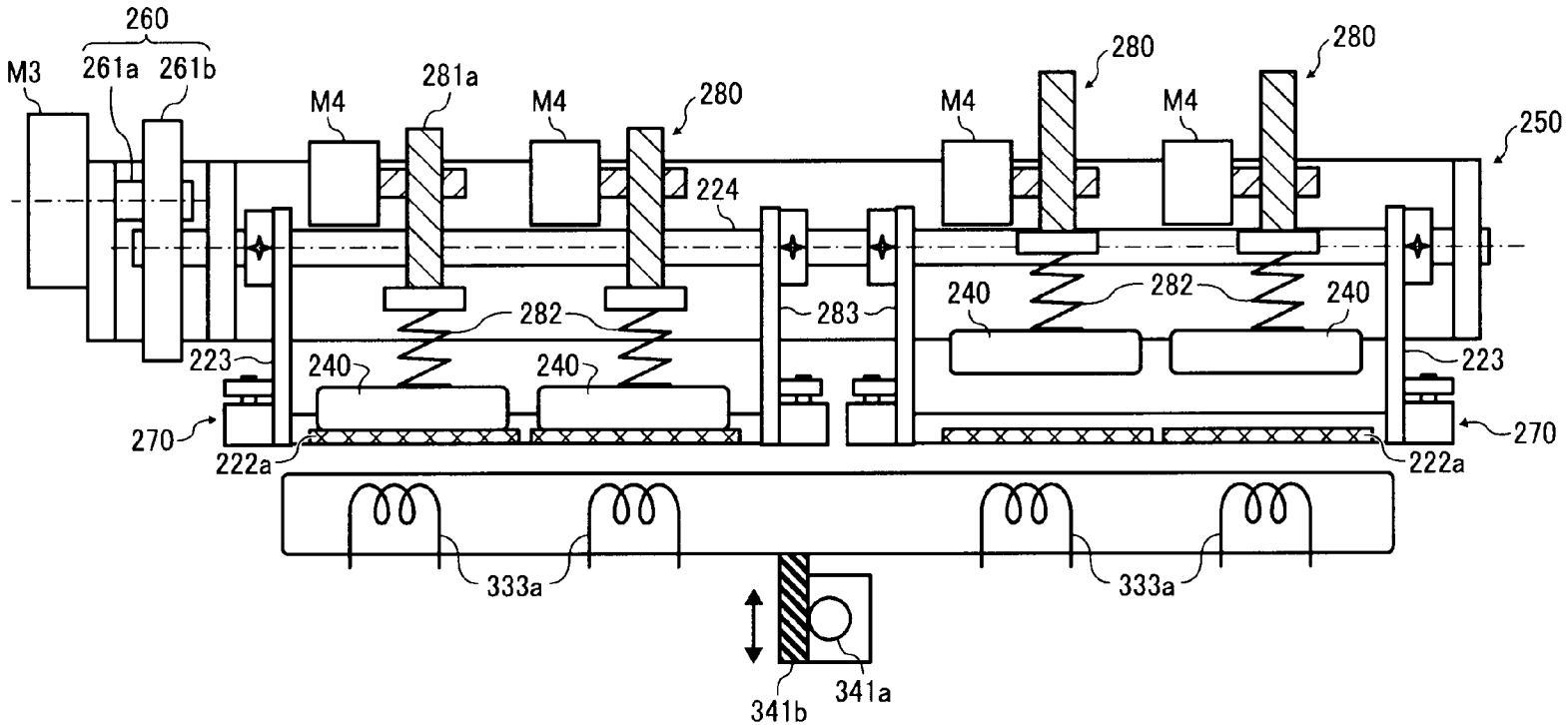
FIG. 21 is a view illustrating the part around the adhesive toner image forming unit seen from a sheet conveyance direction.

FIG. 21 is a view illustrating part around the adhesive toner image forming unit 220 seen from a sheet conveyance direction. As illustrated in FIG. 21, two sets of adhesive toner image forming units 220 are disposed in the main scanning direction (or the sheet width direction).

Figure 22:
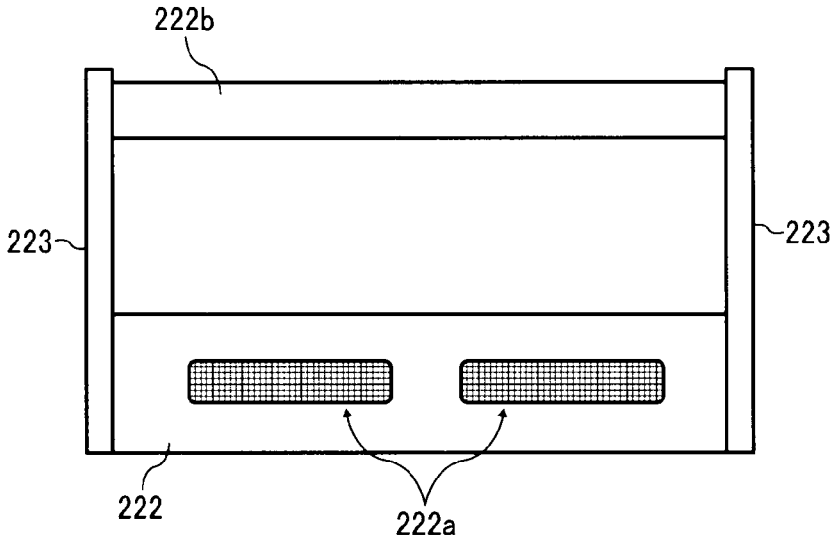
FIG. 22 is a plan view of a toner regulation plate.

FIG. 22 is an overall plan view of a toner regulation plate 222. As illustrated in FIG. 22, the toner regulation plate 222 includes two openings in the main scanning direction and a mesh filter 222*a* is provided to each opening. Suitable materials for the toner regulation plate 222 include stainless steel, copper, or copper plate, having a thickness of from 30 μm to 80 μm. The opening of the toner regulation plate 222 is processed by etching. The shape of the opening corresponds to the shape of the adhesive toner image and the part other than the opening takes the role as a mask. The mesh of the mesh filter has a size allowing toner particles to pass through. Part of the waste toner discharged from the toner supply nozzle 221 that has passed through the mesh filter 222*a* deposits on the predetermined position on the trailing end of the sheet on the sheet stacker 30, and an adhesive toner image having the same shape as that of the opening of the toner regulation plate 222 is formed on the sheet. Thus, by disposing the mesh filter 222*a* on the opening, distribution of toner falling from the opening of the toner regulation plate 222 may be uniform. As a result, the adhesive toner image without uneven density can be formed on the sheet, thereby maintaining the constant adhesive strength.

In addition, by disposing a plurality of adhesive toner image forming units 220, the number of adhesive toner images to be formed on the sheet can be changed.

Both lateral ends of the toner regulation plate 222 in the main scanning direction are fixed to and supported by arm members 223. The toner supply nozzle 221 is also fixed to this arm member 223. Each arm member 223 is a plate with a substantially triangular shape when observed from the main scanning direction as illustrated in FIG. 18. An upper part of the arm member 223 in the vertical direction and downstream of the heater 240 in the sheet conveyance direction (left in FIG. 18) is fixed to a rotation shaft 224. The rotation shaft 224 is rotatably supported to a rigid frame fixed to the apparatus body. An evacuation unit 260 to evacuate the adhesive toner image forming unit 220 from a position opposite the sheet to an evacuated position is disposed at one end of the rotation shaft 224 (left in FIG. 21). The evacuation unit 260 includes an evacuation motor M3, a drive gear 261*a*, and an evacuation gear 261*b*. The drive gear 261*a* is formed on the drive shaft of the evacuation motor M3. The evacuation gear 261*b* engages the drive gear 261*a* and is fixed at one end of the rotation shaft 224. As illustrated in FIG. 22, the arm member 223 extends toward downstream in the sheet conveyance direction than the toner regulation plate 222, and its downstream end is connected to a connection plate 222*b*.

Figure 23:
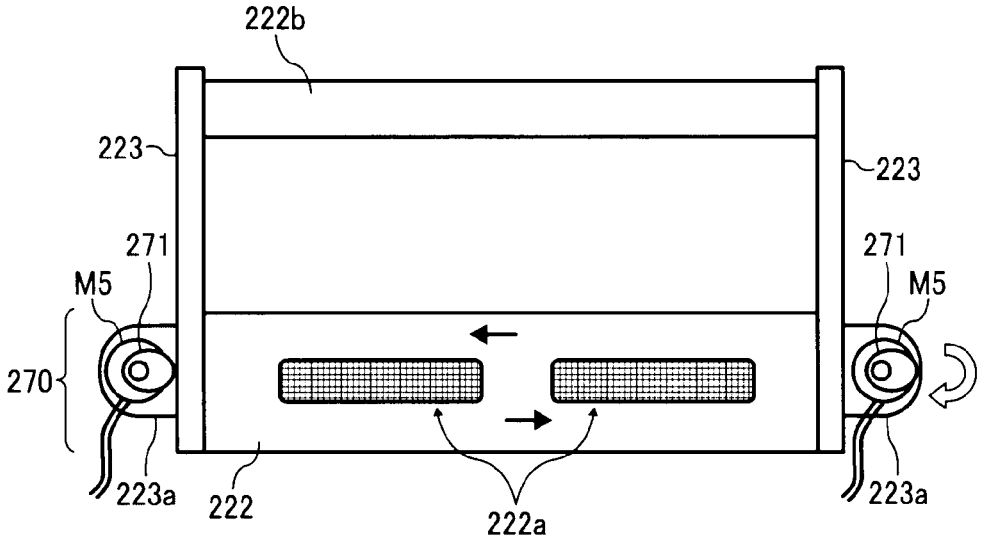
FIG. 23 is a plan view of the toner regulation plate including an oscillation unit.

Further, as illustrated in FIGS. 21 and 23, an oscillation unit 270 to oscillate the toner regulation plate 222 is disposed on an exterior surface of the arm member 223. The oscillation unit 270 includes an oscillation motor M5 formed of a DC micromotor, and an eccentric cam 271 fixed to a driving shaft of the oscillation motor M5. The oscillation motor M5 is disposed on a motor holder 223*a* mounted on an exterior surface of the arm member 223. By rotating the oscillation motor M5, sine curve-shaped slight oscillation is given, thereby allowing the toner regulation plate 222 fixed to the arm member 223 to oscillate in a direction indicated by an arrow in FIG. 23. Thus, by oscillating the toner regulation plate 222, the waste toner discharged from the toner supply nozzle 221 to the mesh filter 222*a* can be securely fallen on the sheet. Accordingly, the waste toner discharged from the toner supply nozzle 221 can be moved onto the sheet, the necessary amount of toner for adhesion can be securely deposited on the sheet, and stable adhesion strength can be obtained. It is noted that the time required to oscillate the toner regulation plate 222 may be several seconds.

As illustrated in FIG. 21, a plurality of heaters 240 (four in the present embodiment) is aligned in the main scanning direction opposite the opening of the toner regulation plate 222. Each heater 240 has the same structure as illustrated in FIG. 3. In addition, each heater 240 includes a heater attach/detach unit 280 to attach or detach the heater 240 to or from the sheet. The heater attach/detach unit 280 includes a heating attach/detach motor M4, a worm gear 281, and a coil spring 282 being a biasing member. One end of the coil spring 282 is fixed to the heater 240 and the other end of the coil spring 282 is fixed to an end of a helical gear 281*a* of the worm gear 281. The helical gear 281*b* of the worm gear 281 is fixed to a driving shaft of the heating attach/detach motor M4.

Figure 24A:
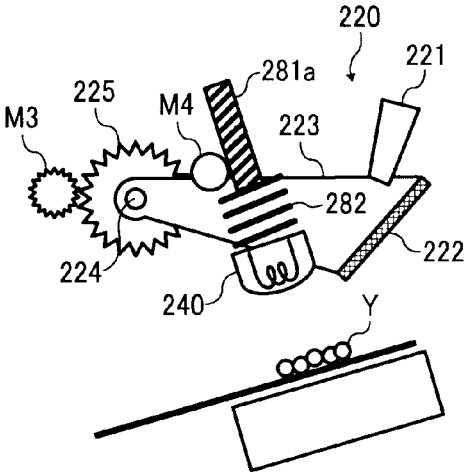
FIGS. 24A to 24C are views illustrating contacting and separating operation of the heater.
Figure 24B:
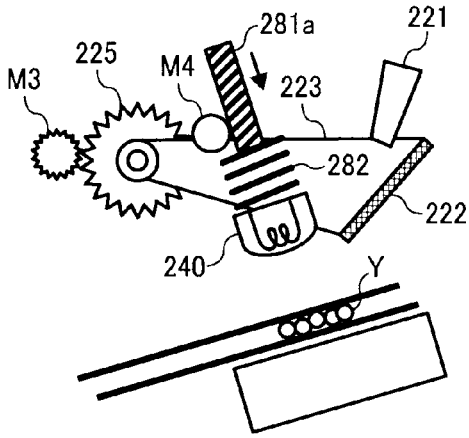
Figure 24C:
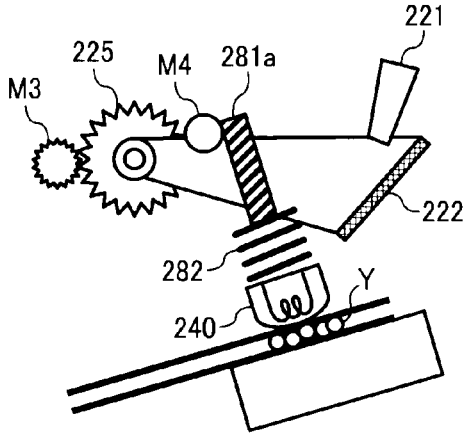

FIG. 24 is a view illustrating attachment and detachment of the heater 240. As illustrated in FIG. 24A, after the adhesive toner image forming unit 220 forms an adhesive toner image Y on the trailing end of the uppermost sheet of the sheet bundle on the sheet stacker 30, the evacuation motor M3 is driven to rotate the arm member 223 in the counterclockwise direction in the figure and the adhesive toner image forming unit 220 is moved to the evacuation position as illustrated in FIG. 24A. Successively, as illustrated in FIG. 24B, when a next sheet is conveyed to the sheet stacker 30, the heating attach/detach motor M4 is driven to lower the heater 240. Then, as illustrated in FIG. 24C, the heater 240 is brought into contact with the uppermost sheet of the sheet bundle in the sheet stacker 30. By displacing the coil spring 282 locating between the heater 240 and the screw gear 281*a*, a proper biasing force is applied to the heater 240. The trailing end of the sheet bundle is pressed and heated, and the adhesive toner image sandwiched between sheets is fused and softened to attach adjacent sheets in the sheet bundle to each other. Position sensors, not shown in the figure, are provided at positions corresponding to the evacuated position of the adhesive toner image forming unit 220 or opposite the uppermost sheet of the sheet bundle on the sheet stacker 30. Then, by turning ON or OFF of the not-shown position sensors, whether the adhesive toner image forming unit 220 has reached the opposite position or the evacuated position is detected, and based on the detection result, the evacuation motor M3 is controlled. On the other hand, attachment and detachment of the heater 240 is controlled based on the momentum of the heating attach/detach motor M4. In the present embodiment, a stepping motor is used as the heating attach/detach motor M4, and the lifting of the heater 240 is controlled by the number of steps.

Figure 25:
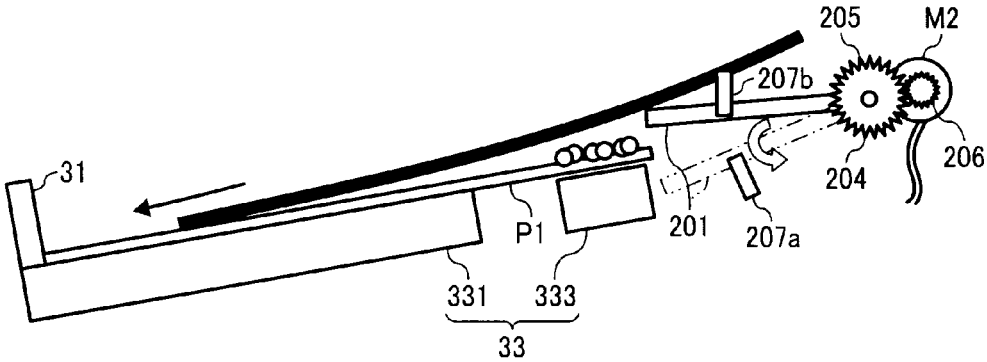
FIG. 25 is an explanatory view illustrating operation of a sheet contact prevention plate.

A sheet contact prevention plate 201 serving to prevent the unfixed adhesive toner image on the sheet conveyed to the sheet stacker 30 from contacting another sheet conveyed to the sheet stacker 30 is disposed upstream of the sheet stacker 30 in the sheet conveyance direction. As illustrated in FIG. 25, an upstream end of the sheet contact prevention plate 201 in the sheet conveyance direction is fixed to a rotation shaft 205 rotatably supported to the apparatus. A rotary gear 204 is fixed to the rotation shaft 205 and the rotary gear 204 engages a motor gear 206 of a contact prevention motor M2. In addition, two position sensors 207*a*, 207*b* to detect a position of the sheet contact prevention plate 201 are disposed to the apparatus body.

When there is no sheet on the sheet stacker 30, the sheet contact prevention plate 201 is located at a home position, detected by the first position sensor 207*a*, indicated by a dotted line in FIG. 25. When a second sheet is conveyed to the sheet stacker 30, the contact prevention motor M2 is driven and the sheet contact prevention plate 201 is rotated in the clockwise direction in the figure, until the second position sensor 207*b* detects the sheet contact prevention plate 201. According to this, the sheet contact prevention plate 201 is positioned at a sheet contact prevention position as illustrated by a solid line in the figure. When the sheet contact prevention plate 201 is positioned at the sheet contact prevention position, the upstream end of the sheet contact prevention plate 201 in the sheet conveyance direction is positioned above a heating plate 333. With this structure, a gap is formed between the backside of the sheet conveyed to the sheet stacker 30 and the adhesive toner image formed on the trailing end of the uppermost sheet of the sheet bundle stacked on the sheet stacker 30. As a result, the backside of the sheet conveyed to the sheet stacker 30 and the adhesive toner image formed on the trailing end of the uppermost sheet of the sheet bundle stacked on the sheet stacker 30 are prevented from contacting each other, thereby preventing the adhesive toner image from being disturbed. Upon the trailing end of the sheet having passed the sheet contact prevention plate 201, the sheet contact prevention plate 201 is caused to rotate in the counterclockwise direction so as to be returned to the home position as indicated by the dotted line in the figure.

A controller unit 400 as illustrated in FIG. 18 includes various drivers to transmit driving signals to respective motors and solenoids, various controllers to control various drivers, a CPU, and the like. The controller unit 400 is configured to, based on adhesive strength and sheet information designated by the user, control waste toner discharge amount from the toner supply nozzle 221, and changes the toner deposition amount per unit area of the adhesive toner image. Further, the controller unit 400 serves to change the thermal quantity to be applied to the sheet bundle by changing the heating time of period to be applied to the heater 240 based on for example the number of sheets being stacked on the sheet stacker 30.

Figure 26:
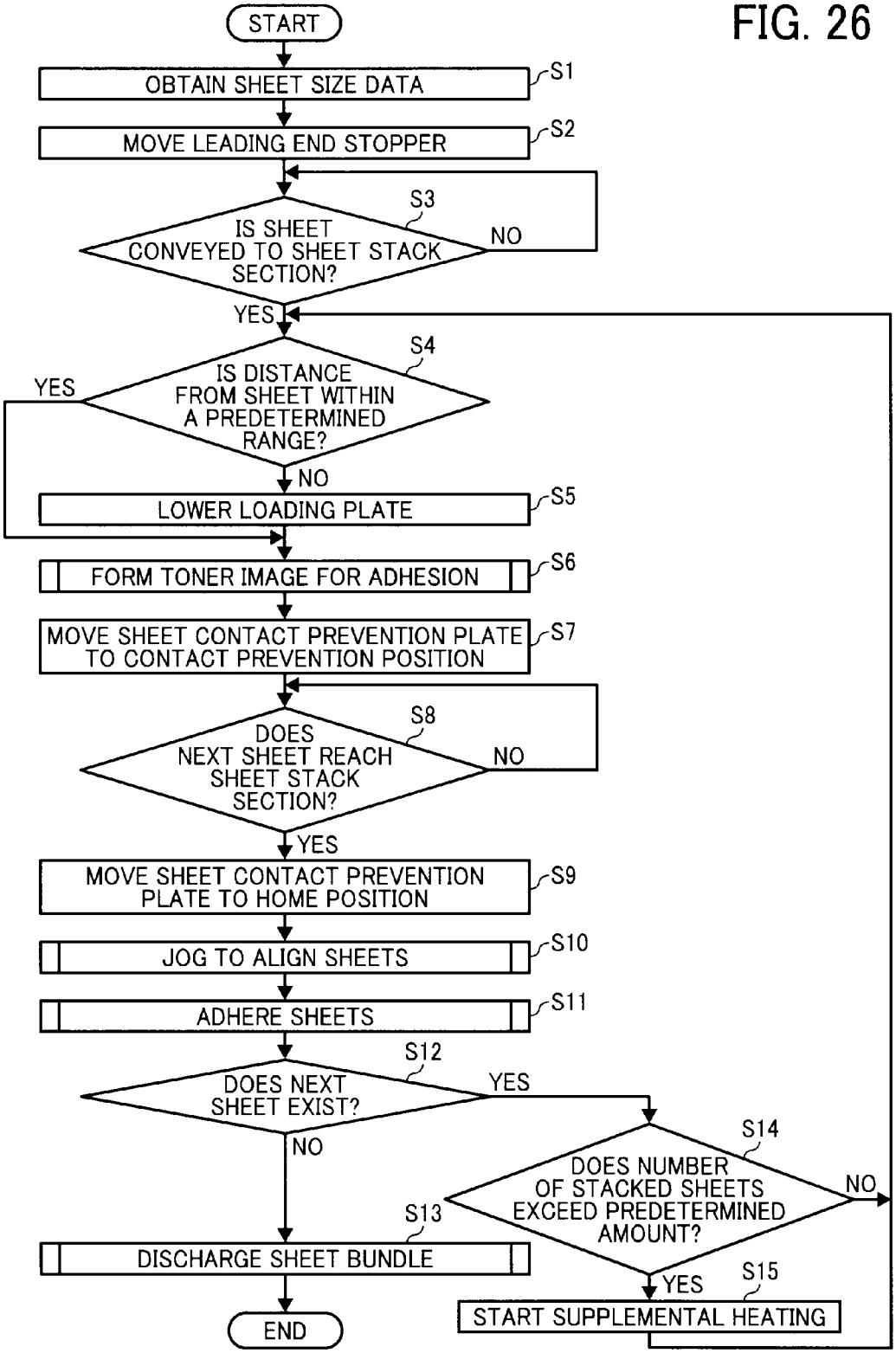
FIG. 26 is a control flowchart to create a complete booklet.

FIG. 26 is a process flow of bookbinding through adhesive toner image formation. First, prior to starting the process, the adhesive toner image forming unit 220 is positioned at an evacuated position (see FIG. 24).

When the CPU as illustrated in FIG. 18 obtains sheet size information to be sent to the sheet stacker 30 (such as A-4 sheet with longitudinal side of 297 mm) in step S1, the stopper motor M6 drives the leading end stopper 31 to a predetermined position (that is, a position in which the trailing end of the sheet conveyed to the sheet stacker 30 is opposite the heater 240 or the opening of the toner regulation plate 222) in step S2. Next, when a first sheet is conveyed to the sheet stacker 30 (YES in step S3), whether the distance between the sheet surface position detection sensor 335 as illustrated in FIG. 20 and the uppermost sheet in the sheet bundle on the sheet stacker 30 is within a predetermined range or not is checked in step S4. When the above distance is not within the predetermined range (NO in step S4), because the adhesive toner image is not allowed to be formed on the sheet, the lifting motor M8 is driven to lower the loading plate 33 in step S5. An initial position of the loading plate 33 is such a position that when the first sheet is conveyed to the sheet stacker 30, the distance between the sheet surface position detection sensor 335 and the uppermost sheet of the sheet bundle on the sheet stacker 30 becomes a predetermined value. Therefore, a control to lower the loading plate 33 is not necessary and the process proceeds to a next step. When the distance between the sheet surface position detection sensor 335 and the uppermost sheet in the sheet bundle on the sheet stacker 30 becomes a predetermined value, the CPU causes to start adhesive toner image formation in step S6.

When the adhesive toner image forming operation starts, the CPU drives the evacuation motor M3 to move the adhesive toner image forming unit 220 from the evacuated position to the position opposite the trailing end of the sheet on the sheet stacker 30. Next, the CPU opens the shutter valve 225, drives a conveyance screw in the waste toner supply path 227 to discharge the waste toner supplied from the waste toner bottle 228, via the toner supply nozzle 221. In addition, the CPU drives the oscillation motor M5 of the oscillation unit 270 to oscillate the toner regulation plate 222. Part of the waste toner discharged from the toner supply nozzle 221 falls from the mesh filter of the toner regulation plate 222 and deposits on the trailing end of the sheet on the sheet stacker 30. According to this, an unfixed adhesive toner image having the same shape as that of the opening of the toner regulation plate 222 is formed on the trailing end of the sheet on the sheet stacker.

The waste toner amount discharged from the toner supply nozzle 221, that is, the deposition amount of the adhesive toner image per unit area is determined based on the information on the adhesive strength, the type of the sheet, and the like. Specifically, the above information is input by the user on the operation panel of the apparatus and is stored in, for example, a nonvolatile memory and is read out when the adhesive toner image is to be formed. The waste toner amount to be supplied can thus be determined based on the readout information of the adhesive strength, the type of the sheet, and the like. Then, the CPU controls driving time of the conveyance screw in the waste toner supply path 227 and timing to close the shutter valve 225 based on the determined waste toner amount. Accordingly, the amount of waste toner corresponding to the adhesion strength, sheet type, and the like, is discharged from the toner supply nozzle 221.

Thus, when the adhesive toner image is formed on the trailing end of the sheet on the sheet stacker 30, the CPU moves the adhesive toner image forming unit 220 from the sheet-opposite position to the evacuated position. Thus, the adhesive toner forming operation terminates.

When the adhesive toner image formation operation terminates, the CPU drives the contact prevention motor M2 to move the sheet contact prevention plate 201 to the contact prevention position as indicated by the solid line in FIG. 25 in step S7. When the second sheet is conveyed to the sheet stacker 30 (YES in step S8), the CPU moves the sheet contact prevention plate 201 to the home position as indicated by the dotted line in FIG. 25 (in step S9), drives the jogger fence 32 to job the sheet (in step S10).

When the sheet jogging and alignment is finished, the CPU causes to start adhesion operation to adhere sheets to each other in step S11. Specifically, the CPU drives the heating attach/detach motor M4 to lower the heater 240 and causes the heater 240 to contact the trailing end of the uppermost sheet of the sheet bundle on the sheet stacker 30. Next, heating current is applied to the sheet heat generator 43 of the heater 240 to cause the heat generator 44 to generate heat (see FIG. 3). The pressure amount and the heating time applied to the sheet bundle by the heater 240 are determined based on the information on the sheet type, supplied amount of the waste toner (or deposition amount of the adhesive toner image per unit area), the number of sheets stacked on the sheet stacker 30, and the like. Specifically, optimal heating time is previously obtained experimentally by varying such conditions as sheet type, supplied amount of waste toner (or deposition amount of the adhesive toner image deposited per unit area), and the number of sheets stacked on the sheet stacker 30, and is stored as a list in the nonvolatile memory. Then, the optimal heating time is determined based on the above table corresponding to sheet type information, sheet number information, adhesive mode (such as the temporary attachment) set by the user on the operation panel of the apparatus. The pressure amount is controlled by the driving time or the momentum of the heating attach/detach motor M4. The trailing end of the sheet bundle is heated for a predetermined time of period, and the unfixed adhesive toner image sandwiched between sheets is fused and softened to thus attach adjacent sheets in the sheet bundle to each other. The temperature of the heater 240 when fixing the adhesive toner image is substantially from 80 to 100 degrees.

After the adjacent sheets are adhered to each other, the heater 240 is lifted up and separated from the sheet bundle and the adhesion operation is terminated.

When the adhesion operation is complete, it is determined whether a next sheet exists or not in step S12. When the next sheet exists (YES in step S12), whether the number of sheets stacked on the sheet stacker 30 is a predetermined number or not is checked in step S14. When it is determined that the number exceeds the predetermined number, the CPU causes to start supplying power to the heat source 333*a* of the heating plate 333 to start auxiliary heating in step S15, and causes to repeat steps after S4. When the number of sheets does not exceed the predetermined number, the CPU causes to repeat steps after S4, without supplying power to the heat source 333*a* of the heating plate 333. The number to start supplying power to the heating plate 333 is determined based on the deposition amount of the adhesive toner image per unit area, required adhesive strength, the type of the sheet, and the like.

On the other hand, when a next sheet does not exist (NO in step S12), the CPU turns on the open/close solenoid SO, lifts up the leading end stopper 31 to adhere the trailing end of the sheets on the sheet stacker 30, and the thus bound booklet is fallen on the stacker 203 with its own weight to terminate the operation. Because the complete booklet is moved from the sheet stacker 30 to the stacker 203, the bookbinding operation can be started without the user having trouble of taking out the complete booklet from the apparatus. Further, because the complete booklet is moved from the sheet stacker 30 to the stacker 203 with its own weight, the move of the complete booklet can be performed with a very simple structure.

In the fourth embodiment, by disposing the adhesive toner image forming unit at a position opposite the sheet stacker 30, adhesion can be performed on a sheet by sheet basis. After the number of sheets to form a booklet has been stacked on the sheet stacker, when each sheet is to be adhered, heat needs to be applied to the plurality of sheets to fuse toner between sheets and high temperature environment and a long heat retention are required. Thus, when there are a great number of sheets in the sheet bundle, there may be any part between sheets in which high temperature environment and long heat retention are not available, and there is a fear that the sheets are not optimally adhered to each other. In addition, so that the sheet bundle with a large number of sheets is bound to be a book, a dedicated apparatus for the high temperature environment and long-time heat retention may be required, which may result in a large size apparatus. In the fourth embodiment, because the sheet can be adhered on a sheet by sheet basis, even when the number of sheets to be a book is large, an optimal adhesiveness can be obtained without disposing any dedicated apparatus for the high temperature environment and long-time heat retention. Sheets with different thickness can be adhered optimally.

Figure 27:
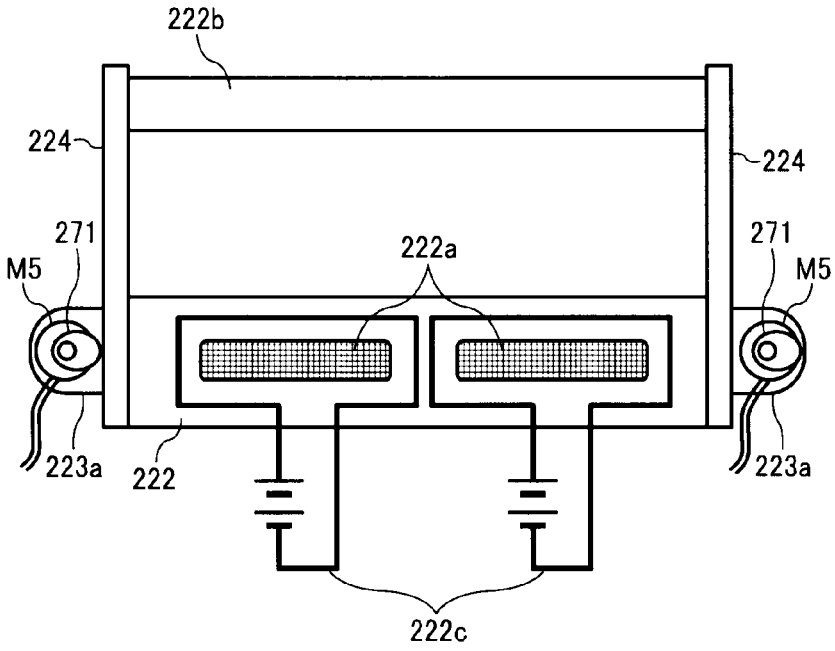
FIG. 27 is a view illustrating a modified example of the toner regulation plate.

FIG. 27 is a view illustrating a modified example of the toner regulation plate 222. The toner regulation plate 222 according to this modified example includes a sheet heater 222*c* as a supplemental heater. By applying heating current to the sheet heater 222*c*, the mesh filter 222*a* is heated together with the toner regulation plate 222. The waste toner discharged from the toner supply nozzle 221, while passing through the mesh filter 222*a*, contacts the mesh filter supplementarily heated and falls on the sheet.

With this structure, in a state in which the adhesive toner image formed on the sheet has been heated to a certain extent, the heater 240 performs adhesion operation. Compared to a case in which the adhesive toner image is not heated, short time of heating is sufficient to obtain the same adhesion strength. In particular, when an ordinary fibrous sheet having a concave/convex surface is used, it is efficient to supplementarily heat the waste toner to be softened by controlling the temperature. Specifically, by softening the toner previously, the toner tends to bite the fibrous surface when heated by the heater 240, and the adhesive toner image can be firmly adhered. Optimal preliminary heating temperature of the waste toner corresponding to the sheet property is previously stored in the nonvolatile memory as a table with relation between the sheet type and the optimal temperature. Using the sheet type information and this table, the optimal preliminary heating temperature is specified, and the CPU controls the heating current to the sheet heater 222*c*.

There is a fear that the slightly softened toner deposited on the mesh filter 222*a* and remaining thereon to be swollen like a ball may degrade the function of filter. Therefore, it is preferable that the mesh filter 222*a* and its circumference be coated with resins such as Teflon (Registered Trade name) having a property to maintain a low friction with toner particles even at a slightly high temperature.

Figure 28:
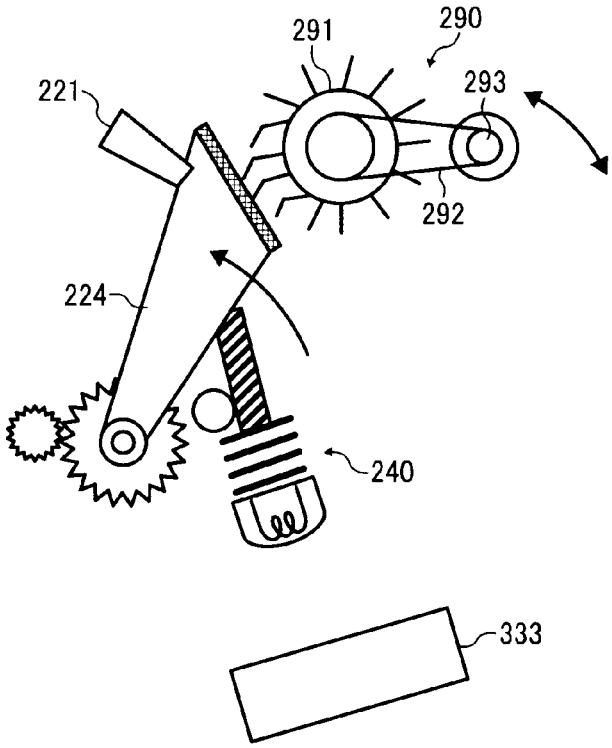
FIG. 28 is a view illustrating a structure in which a cleaning device for the toner regulation plate is provided.

As illustrated in FIG. 28, a regulation plate cleaning device 290 to clean a surface of the toner regulation plate 222 when the adhesive toner image forming unit 220 is in the evacuated position may be provided. The regulation plate cleaning device 290 includes a cleaning brush roller 291. A timing belt 292 is stretched over the cleaning brush roller 291 and a driving shaft 293 of a cleaning motor M9 to drive the cleaning brush roller 291. The cleaning brush roller 291 is configured to contact the mesh filter 222*a* of the toner regulation plate 222 when the adhesive toner image forming unit 220 is brought to the evacuated position. When the cleaning brush roller 291 is brought into contact with the mesh filter 222*a*, the cleaning brush roller 291 scrapes off the waste toner deposited on the mesh filter 222*a* by repeating a forward rotation and reverse rotation according to a constant rotation sequence. The above cleaning is performed while the adhesion process being halted temporarily. The cleaning brush roller 291 is preferably formed of a comparatively rigid nylon brush. Thus, by providing the regulation plate cleaning device 290, clogging of the mesh filter 222*a* due to the remaining waste toner can be suppressed, thereby stably forming the adhesive toner image over a long period. Because the cleaning brush roller 291 cannot be disposed opposite the mesh filter 222*a* at the evacuated position as illustrated in FIG. 24, the adhesive toner image forming unit 220 is further rotated counterclockwise than the position in FIG. 24.

In addition, in the fourth embodiment, the image forming apparatus further includes a post processor separately from the apparatus body; however, the adhesive toner image forming unit 220 and the heater 240 according to the present fourth embodiment may be disposed in the discharged sheet stacker of the image forming apparatus. In this case, a bookbinding system to perform a coherent process from the image formation to the bookbinding may be constructed only by mounting a unit including the heater 240 and the adhesive toner image forming unit 220 to the discharged sheet stacker of an ordinary image forming apparatus. Accordingly, a bookbinding system can be easily formed in the ordinary image forming apparatus.

In addition, in the fourth embodiment, the adhesive toner image formed in the trailing end of the sheet stacked on the sheet stacker 30 is used, but the adhesive toner image formed in the leading end of the sheet may be used either. In this case, the unit to move the leading end stopper 31 in the sheet conveyance direction becomes unnecessary. Alternatively, the adhesive toner image can be formed on the end of the sheet extending in the sheet conveyance direction of the sheet stacked on the sheet stacker 30. In this case, a plurality of toner image forming unit 220 is aligned in the sheet conveyance direction.

As described above, the bookbinding system according to the first to fourth embodiments of the present invention includes an image forming unit 10 to from a toner image on a sheet, a fixing device 2 to fix the toner image onto the sheet, and a sheet stacker 30 to load the sheet that has passed through the fixing device 2 and make a sheet bundle. The bookbinding system further includes an adhesive toner image forming unit 20, 220 to form an adhesive toner image on an area to be a spine of a complete book, and a heater 40, 240 to heat the unfixed adhesive toner image formed on each sheet of the sheet bundle stacked on the sheet stacker 30. With this structure, the unfixed toner image can be used as an adhesive to attach adjacent sheets to each other, and the adhered adjacent sheets can be firmly adhered to each other compared to a case in which the adhesive toner image after fixation is used as an adhesive. Accordingly, the adhesive toner image alone can attach the adjacent sheets firmly, eliminates the need for another unit to bind the sheet bundle, and makes the apparatus inexpensive.

In addition, the bookbinding system according to the second embodiment is configured such that the adhesive toner image passes through the fixing device 2 without being fixed by the fixing device 2. Specifically, the adhesive toner image is formed either at the leading end or at the trailing end of the sheet in the sheet conveyance direction, and a separation unit 50 to separate the pressure roller 2*a* from the heat roller 2*b* is provided. When the adhesive toner passed through the fixing device 2, the pressure roller 2*a* is separated from the heat roller 2*b*. According to this structure, a sheet on which the adhesive toner image in the unfixed state is formed can be stacked on the sheet stacker 30.

Further, the adhesive toner image may be formed at an end extending in the sheet conveyance direction, and the adhesive toner image formed on the sheet is allowed to pass through a portion outside the fixing nip. According to this structure, a sheet on which the adhesive toner image in the unfixed state is formed can be stacked on the sheet stacker 30.

Furthermore, the bookbinding system according to the second embodiment is configured such that the image forming unit 10 forms the adhesive toner image, and therefore, a space saving system can be constructed compared to a case in which the image forming unit 10 and the adhesive toner image forming unit 20 are individually disposed.

Furthermore, the bookbinding system according to the first, third, and fourth embodiments includes the adhesive toner image forming unit 20 disposed downstream of the fixing device 2 in the sheet conveyance direction. Even by such a structure, a sheet on which the adhesive toner image in the unfixed state can be stacked on the sheet stacker 30.

The bookbinding system according to the fourth embodiment includes the adhesive toner image forming unit 220 disposed at the sheet stacker 30. With such a structure, the adhesive toner image forming unit 220 and the heater 240 can be unitized into an integrated unit, and the unit can be mounted to the discharged sheet stacker of an ordinary image forming apparatus, thereby performing bookbinding. Accordingly, a bookbinding system can be easily built in the ordinary image forming apparatus.

The bookbinding system according to the fourth embodiment includes an evacuation unit 260 to evacuate the adhesive toner image forming unit 220 from a position opposite the sheet bundle stacked on the sheet stacker 30. When the heater 240 heats an area corresponding to a spine of a complete book with pressure, the adhesive toner image forming unit 220 is evacuated from a position opposite the sheet bundle stacked on the sheet stacker 30. According to this structure, the area of the sheet bundle on which the adhesive toner image is formed can be pressed and heated by the heater 240.

The bookbinding system according to the fourth embodiment includes a sheet stacker 30 which includes a loading plate 33 on which the sheets are loaded, and a loading plate lifting unit 340 serving to attach/detach the loading plate 33 to and from the adhesive toner image forming unit 220. According to the number of sheets loaded on the loading plate 33, the loading plate 33 is attached to or detached from the adhesive toner image forming unit 220. With this structure, because the distance between the adhesive toner image forming unit 220 and the uppermost sheet of the sheet bundle stacked on the sheet stacker 30 can be kept constant, the adhesive toner image can be optimally formed on the sheet.

Further, the bookbinding system according to the fourth embodiment includes the heater 240 which is configured to heat the adhesive toner image on the sheet stacked on the sheet stacker 30 each time the sheet is conveyed to the sheet stacker 30 to attach adjacent sheets to each other, and the adhesive toner image forming unit 220 which is configured to, after the completion of adhesion process by the heater 240, form an adhesive toner image on an uppermost sheet of the sheet bundle stacked on the sheet stacker 30. According to this structure, an adhesive toner image in the unfixed state on the sheet is heated and the sheets are adhered to each other. According to this structure, regardless of the numbers of the sheets, the adhesive toner image in the unfixed state is fused, and the sheets are adhered to each other.

Further, the bookbinding system according to the fourth embodiment includes the adhesive toner image forming unit 220 including a toner supply nozzle 221 to discharge toner, in which the toner discharged from this toner supply nozzle 221 is deposited on the sheet to form an adhesive toner image. With this structure, compared to a case in which the adhesive toner image is formed on the sheet using the electrophotographic method, the adhesive toner image can be formed on the sheet with an uncomplicated structure. Because there is no need for providing a means to move toner electrostatically required in the electrophotographic method, energy saving can be achieved.

Further, the adhesive toner image forming unit 220 in the bookbinding system according to the fourth embodiment includes a toner regulation plate 222 which includes an opening, is disposed between the toner supply nozzle 221 and the sheet, and regulates a discharge area of the toner discharged on the sheet so that the adhesive toner image with a predetermined shape is formed on the sheet. With this structure, the adhesive toner image with a predetermined shape can be formed stably.

Further, by providing a mesh filter 222*a* to the opening of the toner regulation plate 222, the amount of toner deposited on the adhesive toner image to be formed on the sheet can be uniform, thereby preventing the uneven adhesion of the adhesive toner image.

Further, provision of an oscillation unit 270 to oscillate the toner regulation plate 222 prevents clogging of the mesh filter 222*a* by the toner. Accordingly, the toner discharged from the toner supply nozzle 221 can be deposited on the sheet and a shortage in the toner deposition amount can be suppressed.

Further, by providing the regulation plate cleaning device 290 to clean the toner regulation plate 222, clogging of the mesh filter 222*a* can be suppressed. Further, by providing a mesh filter 222*a* to the opening of the toner regulation plate 222, the amount of toner deposited on the adhesive toner image to be formed on the sheet can be uniform, thereby preventing uneven adhesion of the adhesive toner image.

Further, because the bookbinding system according to the fourth embodiment includes a plurality of adhesive toner image forming units 220, the number of adhesive toner images to be formed on the sheet can be changed in accordance with the intended use.

Further, because the low-melting-point toner is used as the toner to be deposited on the sheet by the adhesive toner image forming unit compared to the toner to be deposited by the image forming unit, the heat quantity to fuse the adhesive toner image can be lessened and the heating time of the heater can be shortened, thereby achieving energy saving.

The toner to be deposited on the sheet by the adhesive toner image forming unit may be waste toner. By using the waste toner, natural resources may be used efficiently. Further, in the bookbinding system according to the fourth embodiment, the adhesive toner image forming unit includes a sheet heater to preliminarily heat the toner to be deposited on the sheet. Then, the preliminarily heated and slightly softened toner can be deposited on the sheet. Accordingly, the toner to form the adhesive toner image tends to bite the fibrous surface when heated by the heater, and the secured adhesion strength can be obtained. In the first and third embodiment as well, by disposing the preliminary heater for the adhesive toner image forming unit, secured adhesion property can be obtained.

Further, by changing the deposition amount of the adhesive toner image per unit area, the adhesion strength between sheets can be changed. Accordingly, the adhesion strength can be changed depending on the intended use of the complete book.

Further, because the contact surface of the heater 40, 240 contacting the sheet bundle has a curved surface, a high contact pressure can be obtained and the degree of adhesion between the sheets with toner can be increased, thereby achieving firm adhesion.

Further, because the heater 40, 240 includes means to change the thermal capacity applied to the sheet bundle, the adhesion strength can be changed. Accordingly, the adhesion strength can be changed depending on the intended use of the complete book. Optimal thermal capacity can be applied to the sheet bundle depending on the number of sheets included in the sheet bundle, the type of the sheet, and the like.

Further, the bookbinding system according to the fourth embodiment includes a contact prevention plate 201 to prevent the adhesive toner image on the uppermost sheet of the sheet bundle stacked on the sheet stacker 30 from contacting or scraping against another sheet conveyed to the sheet stacker 30. According to this structure, the adhesive toner image formed on the sheet stacked in the sheet stacker 30 can be prevented from being disturbed. Even in the structures according to the first to third embodiments, provision of the contact prevention plate may prevent the adhesive toner image formed on the sheet stacked in the sheet stacker 30 from being disturbed.

In addition, according to the bookbinding system according to the fourth embodiment, because the bound and complete book is moved from the sheet stacker 30 to the stacker 203 for the complete book, a next bookbinding operation can be started without the user removing the complete book from the sheet stacker 30.

Additional modifications and variations of the present invention are possible in light of the above teachings. It is therefore to be understood that, within the scope of the appended claims, the invention may be practiced other than as specifically described herein.

What is claimed is:

1. A bookbinding system comprising:

an image forming unit to form a toner image on a sheet;

a fixing device to fix the toner image onto the sheet;

a sheet stacker to load sheets passing through the fixing device to create a sheet bundle including the sheet;

an adhesive toner image forming unit to form an adhesive toner image on an area of each sheet of the sheet bundle corresponding to a spine of a complete book; and a heater to heat the adhesive toner image formed on each sheet of the sheet bundle, wherein the adhesive toner image of each sheet of the sheet bundle is an unfixed toner image that is fixed by the heater onto a respective sheet for a first time in the sheet stacker, and wherein each sheet of the sheet bundle is stacked in a position on the sheet stacker and the sheet bundle is adhered to produce the complete book.

2. The bookbinding system as claimed in claim 1, wherein the adhesive toner image forming unit is disposed upstream of the fixing device in a sheet conveyance direction, and the fixing device is configured to pass a respective unfixed toner image formed on the sheet without fixing onto the sheet.

3. The bookbinding system as claimed in claim 2, wherein the fixing device comprises:

a second heater to heat the toner image on the sheet;

a nip forming member that contacts the second heater to form a fixing nip through which the sheet passes and the toner image on the sheet is heated and fixed onto the sheet;

and a separation unit to separate the nip forming member from the heater, wherein the nip forming member is separated from the second heater when a respective adhesive toner image formed on the sheet passes through the fixing device, and wherein the adhesive toner image forming unit forms the respective adhesive toner image at a leading end or a trailing end of the sheet.

4. The bookbinding system as claimed in claim 2, wherein the fixing device comprises:

a second heater to heat the toner image on the sheet, and a nip forming member that contacts the second heater to form a fixing nip through which the sheet passes and the toner image on the sheet is heated and fixed onto the sheet, wherein the adhesive toner image forming unit forms a respective adhesive toner image at an end of the sheet extending in the sheet conveyance direction, and wherein the respective adhesive toner image formed on the sheet is passed outside the fixing nip.

5. The bookbinding system as claimed in claim 2, wherein the image forming unit functions as the adhesive toner image forming unit.

6. The bookbinding system as claimed in claim 1, wherein the adhesive toner image forming unit is disposed downstream of the fixing device in a sheet conveyance direction.

7. The bookbinding system as claimed in claim 6, wherein the adhesive toner image forming unit is disposed at the sheet stacker.

8. The bookbinding system as claimed in claim 7, further comprising an evacuation unit, wherein the heater is configured to heat, while pressing, a portion to be the spine of the complete book when the sheet bundle is bound, and wherein the evacuation unit is configured to evacuate the adhesive toner image forming unit from a position opposite the position on the sheet stacker.

9. The bookbinding system as claimed in claim 7, wherein the sheet stacker comprises:

a loading plate to load the sheet; and a lifting unit to attach and detach the loading plate to and from the adhesive toner image forming unit selectively depending on a number of sheets loaded on the loading plate.

10. The bookbinding system as claimed in claim 7, wherein the heater is configured to heat a respective adhesive toner image on one of a first sheet and an uppermost sheet of the sheet bundle to attach adjacent sheets each time a next sheet of the sheet bundle is conveyed to the sheet stacker, and wherein the adhesive toner image forming unit is configured to form an adhesive toner image on the next sheet of the sheet bundle after the adjacent sheets are attached by the heater.

11. The bookbinding system as claimed in claim 1, wherein the adhesive toner image forming unit comprises a toner supply nozzle and is configured to deposit the toner discharged from the toner supply nozzle on each sheet of the sheet bundle to form respective adhesive toner images.

12. The bookbinding system as claimed in claim 11, wherein the adhesive toner image forming unit comprises:

a toner regulation plate that has an opening therein, is disposed between the toner supply nozzle and one of a first sheet and an uppermost sheet of the sheet bundle, and regulates a supply area of the toner deposited so that a respective adhesive toner image with a predetermined shape is formed on the one of the first sheet and the uppermost sheet of the sheet bundle.

13. The bookbinding system as claimed in claim 12, wherein the toner regulation plate further comprises:

a mesh filter disposed at the opening in the regulation plate.

14. The bookbinding system as claimed in claim 13, further comprising:

an oscillation unit to oscillate the toner regulation plate; and a cleaning unit to clean the toner regulation plate.

15. The bookbinding system as claimed in claim 11, further comprising:

a contact suppression plate to prevent an adhesive toner image formed on an uppermost sheet of the sheet bundle from contacting or scraping against another sheet being conveyed to the sheet stacker.

16. The bookbinding system as claimed in claim 1, wherein an adhesive toner of the adhesive toner image forming unit has a lower melting point than a melting point of a toner deposited on the sheet by the image forming unit.

17. The bookbinding system as claimed in claim 1, wherein an adhesive toner of the adhesive toner image forming unit is waste toner.

18. The bookbinding system as claimed in claim 1, further comprising:

a supplementary heater to heat a toner deposited by the adhesive toner image forming unit.

19. The bookbinding system as claimed in claim 1, further comprising:

a controller that changes a deposition amount of toner deposited per unit area of a respective adhesive toner image on the sheet and an optimal quantity of heat generated by the heater.

20. The bookbinding system as claimed in claim 1, wherein the heater has a curved contact surface contacting an uppermost sheet in the sheet bundle.

21. The bookbinding system as claimed in claim 1, wherein the adhesive toner image forming unit comprises a toner regulation plate mounted on arms that rotate about a rotation shaft to pivot the regulation plate about the rotation shaft towards and away from the sheet stacker, wherein the toner regulation plate regulates a deposition of adhesive toner on to an uppermost sheet of the sheet bundle.

22. The bookbinding system as claimed in claim 21, wherein the adhesive toner image forming unit further comprises a mesh filter and a sheet heater, wherein the sheet heater heats the mesh filter and the adhesive toner passes through the mesh filter and is heated before the adhesive toner falls on the sheet to form a respective unfixed toner image.

* * * * *